US009132444B2

(12) United States Patent
Masuo et al.

(10) Patent No.: US 9,132,444 B2
(45) Date of Patent: Sep. 15, 2015

(54) COATING APPARATUS AND INKJET RECORDING APPARATUS

(71) Applicant: FUJIFILM CORPORATION, Tokyo (JP)

(72) Inventors: Tsutomu Masuo, Kanagawa (JP); Naoya Okano, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 117 days.

(21) Appl. No.: 13/935,915

(22) Filed: Jul. 5, 2013

(65) Prior Publication Data

US 2014/0020625 A1 Jan. 23, 2014

(30) Foreign Application Priority Data

Jul. 17, 2012 (JP) ..... 2012-158800

(51) Int. Cl.

| | |
|---|---|
| ***B05C 9/12*** | (2006.01) |
| ***B05C 11/10*** | (2006.01) |
| ***B05C 1/08*** | (2006.01) |
| ***B41J 11/00*** | (2006.01) |

(52) U.S. Cl.

CPC ..... *B05C 9/12* (2013.01); *B05C 1/0813* (2013.01); *B05C 11/1039* (2013.01); *B41J 11/0015* (2013.01)

(58) Field of Classification Search

CPC .... B05C 9/12; B05C 1/0813; B05C 11/1039; B41J 11/0015

USPC ..... 118/600, 603, 610, 259, 266, 231; 347/1, 104, 105

See application file for complete search history.

(56) References Cited

U.S. PATENT DOCUMENTS

| | | | | |
|---|---|---|---|---|
| 3,936,549 | A * | 2/1976 | Kohler et al. | 427/348 |
| 2009/0085999 | A1 | 4/2009 | Furukawa | |
| 2009/0246396 | A1 * | 10/2009 | Nakazawa et al. | 427/428.18 |
| 2012/0113186 | A1 | 5/2012 | Fukui et al. | |

FOREIGN PATENT DOCUMENTS

| | | | |
|---|---|---|---|
| JP | S63-25537 | U | 2/1988 |
| JP | H07-052398 | A | 2/1995 |
| JP | H11-128797 | A | 5/1999 |

(Continued)

OTHER PUBLICATIONS

An Office Action; "Notice of Reasons for Rejection," issued by the Japanese Patent Office on Jun. 17, 2014, which corresponds to Japanese Patent Application No. 2012-158800 and is related to U.S. Appl. No. 13/935,915; with English language translation of relevant portions.

*Primary Examiner* — Laura Edwards

(74) *Attorney, Agent, or Firm* — Studebaker & Brackett PC

(57) ABSTRACT

A coating apparatus includes: a transport unit configured to transport an object to be coated; a coating liquid pan configured to store a coating liquid; a roller configured to be partially immersed in the coating liquid, rotate around an axis to draw up the coating liquid, and coat the coating liquid on the object; a support unit configured to detachably support the coating liquid pan and slidably supports the coating liquid pan; a positioning unit configured to position the coating liquid pan attached to the support unit at an attachment position; and a relative movement unit configured to relatively moves the support unit and the roller. When the support unit is located at an immersion position, a part of the roller is immersed in the coating liquid. When the support unit is located at a retraction position, the coating liquid pan is slidably supported without contact with the roller.

20 Claims, 15 Drawing Sheets

(56) References Cited

FOREIGN PATENT DOCUMENTS

| | | | |
|---|---|---|---|
| JP | 2009-082821 | A | 4/2009 |
| JP | 2010-089015 | A | 4/2010 |
| JP | 2011-194331 | A | 10/2011 |
| JP | 2012-101439 | A | 5/2012 |

* cited by examiner

COATING APPARATUS AND INKJET RECORDING APPARATUS

BACKGROUND OF THE INVENTION

1. Field of the Invention

The present invention relates to a coating apparatus and an inkjet recording apparatus, and in particular, to a technique for drawing up a coating liquid stored in a coating liquid pan with a roller and roller-coating the drawn coating liquid on a sheet being transported.

2. Description of the Related Art

If printing is performed on a general-use printing sheet (a sheet primarily containing cellulose, such as a coated sheet, for use in offset printing or the like), instead of an inkjet-only sheet, by an inkjet method, feathering, bleeding, or the like may occur, and high-quality printing may not be performed. For this reason, in a system which performs printing on a general-purpose printing sheet by an inkjet method, a processing liquid having a function of aggregating ink is given to the sheet before ink ejection in droplets.

As a system which performs high-speed printing on a sheet by an inkjet method, a system is known, in which a sheet is drum-transported, and printing is performed using a line head. In such system in which a sheet is drum-transported and printing is performed, a method which coats a processing liquid by a roller is suitably used (for example, JP2011-194331A).

In such method according to which a processing liquid is coated by a roller, a coating roller is pressed into contact with a surface of a sheet wound around the circumferential surface of the transport drum and transported, and thereby the processing liquid is coated on the sheet. The supply of the processing liquid to the coating roller is performed by a coating liquid supply roller, and the processing liquid stored in a coating liquid pan is drawn up by the coating liquid supply roller and supplied to the coating roller. That is, a part of the coating liquid supply roller is immersed in the processing liquid stored in the coating liquid pan, and the coating liquid supply roller is brought into contact with the outer circumferential surface of the coating roller, and thereby the processing liquid is given to the outer circumferential surface of the coating roller.

On the other hand, in the coating apparatus configured as above, if the coating apparatus is used for a long period of time, the components of the processing liquid is fixed to the coating liquid pan, and/or foreign substances are mixed with the processing liquid in the coating liquid pan. For this reason, it is necessary to detach and clean the coating liquid pan regularly (so-called maintenance).

SUMMARY OF THE INVENTION

However, as described above, in a method according to which a coating liquid supply roller draws a processing liquid and supplies the processing liquid to the coating roller, since the coating liquid supply roller is arranged inside the coating liquid pan, when detaching and cleaning the coating liquid pan, the coating liquid supply roller should be detached simultaneously, and there is a problem in the cleaning takes time and effort.

The invention has been made in consideration of the above-described situation, and an object of the invention is to provide a coating apparatus and an inkjet recording apparatus capable of simply performing maintenance.

Means for solving the problem is as follows.

A first aspect of the invention provides a coating apparatus including a transport unit configured to transport an object to be coated, the object having a sheet-like shape, a coating liquid pan configured to store a coating liquid, a roller configured to the partially immersed in the coating liquid stored in the coating liquid pan, rotate around an axis to draw up the coating liquid, coat the drawn coating liquid directly or indirectly on the object transported by the transport unit, a support unit configured to detachably support the coating liquid pan and slidably supports the coating liquid pan attached to the support unit in a direction perpendicular to the rotation axis of the roller, a positioning unit configured to position the coating liquid pan attached to the support unit at an attachment position, and a relative movement unit configured to relatively moves the support unit and the roller. When the support unit is located at an immersion position relatively with respect to the roller by the relative movement unit in a state where the coating liquid pan is located at the attachment position, a part of the roller is immersed in the coating liquid stored in the coating liquid pan. When the support unit is located at a retraction position relatively with respect to the roller by the relative movement unit, the coating liquid pan is slidably supported without being brought into contact with the roller.

According to this aspect, the coating liquid pan is detachably supported by the support unit. The coating liquid pan supported by the support unit is slidably supported in the direction perpendicular to the rotation axis of the roller, and positioned so as to be located at the attachment position by the positioning unit. The support unit is provided relatively movably (for example, movably up and down) with respect to the roller by the relative movement unit, and when the support unit is located at the immersion position in a state where the coating liquid pan is located at the attachment position, a part of the roller is immersed in the coating liquid stored in the coating liquid pan. When the support unit is located at the retraction position, the coating liquid pan is slidably supported without coming into contact with the roller. Accordingly, it is possible to detach the coating liquid pan from the support unit. In this way, according to this aspect, it is possible to detach the coating liquid pan independently. Therefore, it is possible to simply perform maintenance. That is, since the attachment and detachment of the coating liquid pan is possible without detaching the roller separately, it is possible to easily perform maintenance, such as cleaning.

According to a second aspect, in the coating apparatus of the first aspect, the transport unit may be a transport drum configured to rotate with the object being wound around a circumferential surface thereof and thereby transport the object.

According to this aspect, the transport unit is constituted by the transport drum. The object to be coated is wound around the circumferential surface of the rotating transport drum and transported. In this case, the object to be coated is transported along an arc-shaped transport path which is formed along the circumferential surface of the transport drum.

According to a third aspect, the coating apparatus of the first or second aspect may further include a receiving pan arranged below the coating liquid pan. The receiving pan may be configured to recover the coating liquid overflowing from the coating liquid pan.

According to this aspect, the receiving pan is arranged below the coating liquid pan. Therefore, for example, even if the coating liquid overflows from the coating liquid pan at the time of the attachment and detachment of the coating liquid pan or the like, the coating liquid can be recovered by the receiving pan, and thus there is no case where the surrounding is contaminated.

According to a fourth aspect, in the coating apparatus of the third aspect, the support unit may be provided in the receiving pan, and the relative movement unit may move the receiving pan relatively with respect to the roller and thereby move the support unit relatively with respect to the roller.

According to this aspect, the support unit is provided in the receiving pan, and the receiving pan is moved relatively with respect to the roller by the relative movement unit, thereby moving the support unit relatively with respect to the roller. The support unit is constituted by, for example, the bottom surface of the receiving pan, and slidably supports the coating liquid pan along the bottom surface of the receiving pan. Therefore, it is possible to achieve simplification and compactness of the configuration.

According to a fifth aspect, in the coating apparatus of the fourth aspect, the receiving pan may be swingably supported around a swing shaft parallel to the rotation axis of the roller, and the relative movement unit may swing the receiving pan around the swing shaft and thereby move the support unit relatively with respect to the roller.

According to this aspect, the receiving pan is supported swingably around the swing shaft parallel to the rotation axis of the roller. The relative movement unit swings the receiving pan to move the receiving pan relatively with respect to the roller. Therefore, it is possible to simplify a relative movement mechanism. That is, since a configuration of moving only the receiving pan is required, it is possible to simplify a relative movement mechanism.

According to a sixth aspect, in the coating apparatus of the fifth aspect, the relative movement unit may include an arm of which lower end portion is connected to the receiving pan and which extends upward. The relative movement unit may move the arm up and down and thereby have the receiving pan swing.

According to this aspect, the arm extending upward from the receiving pan is moved up and down to swing the receiving pan. Therefore, for example, even when there is no space for providing the relative movement unit below the receiving pan, it is possible to move the receiving pan relatively. For example, when the object to be coated is transported using the upper side of the transport drum (when an upper arc of the transport drum becomes the transport path of the object to be coated), the coating roller is provided above the transport drum, and the roller and the coating liquid pan are provided in conformity with the coating roller. In such case where the coating liquid pan is provided above the transport drum, there is no effective empty space for providing the relative movement unit below the coating liquid pan. On the other hand, according to this aspect, a configuration in which the receiving pan is swung by the arm extending upward from the receiving pan makes it possible to swing the receiving pan effectively using the upper empty space.

According to a seventh aspect, in the coating apparatus of the sixth aspect, the roller may be attached to a support portion which is configured to support the roller. The roller may be attached to the support portion in such a manner that the roller is detached from a given direction with respect to the support portion. The arm may provided in such a manner that the arm avoid a movement path of the roller at a time of attachment and detachment of the roller.

According to this aspect, when the roller is detachable, the arm is provided so as to avoid the movement path of the roller at the time of attachment and detachment of the roller. That is, the arm is provided so as not to interfere with the coating liquid supply roller at the time of attachment and detachment of the coating liquid supply roller (i.e., the arm is provided so as not to being brought into contact with the coating liquid supply roller). For example, the arm is formed bent so as to avoid the support portion of the roller.

According to an eighth aspect, the coating apparatus of any one of the first to seventh aspects may further include a supply port which is provided in the coating liquid pan, a coating liquid supply unit configured to supply the coating liquid to the coating liquid pan through the supply port, a waste liquid discharge port which is provided in the coating liquid pan, a waste coating liquid discharge unit configured to discharge the coating liquid from the coating liquid pan through the waste liquid discharge port, a detection unit configured to detect a position of the support unit, and a supply and waste liquid discharge control unit configured to control the coating liquid supply unit and the waste coating liquid discharge unit based upon a result of detection by the detection unit.

According to this aspect, the position of the support unit is detected by the detection unit. The supply and discharge of the coating liquid are performed on the basis of the detection result. Therefore, it is possible to perform the supply and discharge of the coating liquid safely. That is, for example, the position of the coating liquid pan supported by the support unit is understood on the basis of the position of the support unit, and the supply and discharge of the coating liquid can be performed only when the coating liquid pan is attached at a regular position. Thus, it is possible to prevent the supply or discharge of the coating liquid when the coating liquid pan is not attached, and to perform the supply and discharge of the coating liquid safely.

According to a ninth aspect, in the coating apparatus of the eighth aspect, the coating liquid supply unit may be connected to the supply port through a valved coupling, and the waste coating liquid discharge unit is connected to the waste liquid discharge port through a valved coupling.

According to this aspect, the coating liquid supply unit is connected to the supply port through the valved coupling. The waste coating liquid discharge unit is connected to the waste liquid discharge port through the valved coupling. Therefore, it is possible to prevent the coating liquid from overflowing and contaminating the surrounding at the time of detachment of the coating liquid pan.

According to a tenth aspect, the coating apparatus of any one of the first to ninth aspects may further include a circulation supply port which is provided in the coating liquid pan, a circulation recovery port which is provided in the coating liquid pan, a circulation pipe which communicates the circulation supply port and the circulation recovery port, and a circulation pump which is provided in the circulation pipe, the circulation pump being configured to circulate the coating liquid stored in the coating liquid pan through the circulation pipe.

According to this aspect, the coating liquid stored in the coating liquid pan is circulated and supplied. Therefore, it is possible to prevent the coating liquid from being concentrated and to continuously coat the coating liquid with given quality.

According to an eleventh aspect, in the coating apparatus of the tenth aspect, the circulation pipe may be connected to the circulation supply port and the circulation recovery port through a valved coupling.

According to this aspect, the circulation pipe is connected to the circulation supply port and the circulation recovery port through the valved coupling. Therefore, it is possible to prevent the coating liquid from overflowing and contaminating the surrounding at the time of detachment of the coating liquid pan.

According to a twelfth aspect, in the coating apparatus of the tenth or eleventh aspect, the circulation supply port may be provided at one end (first end portion) in a width direction of the coating liquid pan, and the circulation recovery port may be provided at the other end (second end portion) in the width direction of the coating liquid pan.

According to this aspect, the circulation supply port is provided at one end in the width direction of the coating liquid pan, and the circulation recovery port is provided at the other end. Therefore, it is possible to circulate the entire coating liquid stored in the coating liquid pan without stagnation.

According to a thirteenth aspect, the coating apparatus of any one of the tenth to twelfth aspects may further include a filter which is provided in the circulation pipe, the filter being configured to filter the coating liquid flowing through the circulation pipe.

According to this aspect, the filter is provided in the circulation pipe. Therefore, it is possible to remove a foreign substance from the processing liquid stored in the coating liquid pan.

According to a fourteenth aspect, in the coating apparatus of any one of the tenth to thirteenth aspects, the circulation pump may be configured to switch a liquid feed direction.

According to this aspect, the circulation pump is configured so as to switch in the liquid feed direction (circulation direction) (for example, the circulation pump is constituted by a tube pump or the like). Therefore, for example, it is possible to normally circulate the coating liquid to flow from the circulation supply port toward the circulation recovery port inside the coating liquid pan, and as necessary, to circulate the coating liquid to flow from the circulation recovery port toward the circulation supply port inside the coating liquid pan. If the coating liquid is constantly circulated to flow from the circulation supply port toward the circulation recovery port, a foreign substance or the like remains in the flow channel on the recovery side of the circulation recovery port or the circulation pipe, and inhibits the flow of the coating liquid. Meanwhile, if the coating liquid flows in the opposite direction as necessary, it is possible to sweep a foreign substance or the like remaining in the flow channel on the recovery side of the circulation recovery port or the circulation pipe inside the coating liquid pan. Therefore, it is possible to prevent clogging of the circulation recovery port or the circulation pipe.

According to a fifteenth aspect, the coating apparatus of any one of the first to fourteenth aspects may further include a cleaning unit which is provided inside the coating liquid pan, the cleaning unit being configured to being brought into contact with the circumferential surface of the roller and thereby clean the circumferential surface of the roller. When the support unit is located at a cleaning position, the cleaning unit may be brought into contact with the circumferential surface of the roller.

According to this aspect, the cleaning unit (for example, a brush, a sponge, or the like) is provided inside the coating liquid pan. Since the coating liquid pan is provided to move relatively with respect to the roller by the relative movement unit, as necessary, the coating liquid pan is moved up, and the cleaning unit is brought into contact with the circumferential surface of the roller, thereby cleaning the circumferential surface of the roller. Therefore, it is possible to constantly maintain the circumferential surface of the roller in a clean state, and to stably coat the coating liquid on the object to be coated.

According to a sixteenth aspect, an inkjet recording apparatus includes the coating apparatus according to any one of the first to fifteenth aspects, and an inkjet head configured to eject ink onto the object to be coated which is coated with the coating liquid by the coating apparatus and thereby record an image.

According to this aspect, an image is recorded on the object to be coated with the coating liquid coated thereon by the coating apparatus by an inkjet method. The object to be coated is coated with the coating liquid by the coating apparatus, and is then delivered to the transport unit through intermediate transport means. Then, ink is ejected from the inkjet head during the transport by the transport means, and an image is recorded.

According to the invention, it is possible to simply perform maintenance of a coating apparatus and an inkjet recording apparatus.

DESCRIPTION OF THE PREFERRED EMBODIMENTS

Hereinafter, a preferred embodiment of the invention will be described in detail referring to the accompanying drawings.

First, the overall configuration of an inkjet recording apparatus will be described.

<<Overall Configuration of Inkjet Recording Apparatus>>

Figure 1:
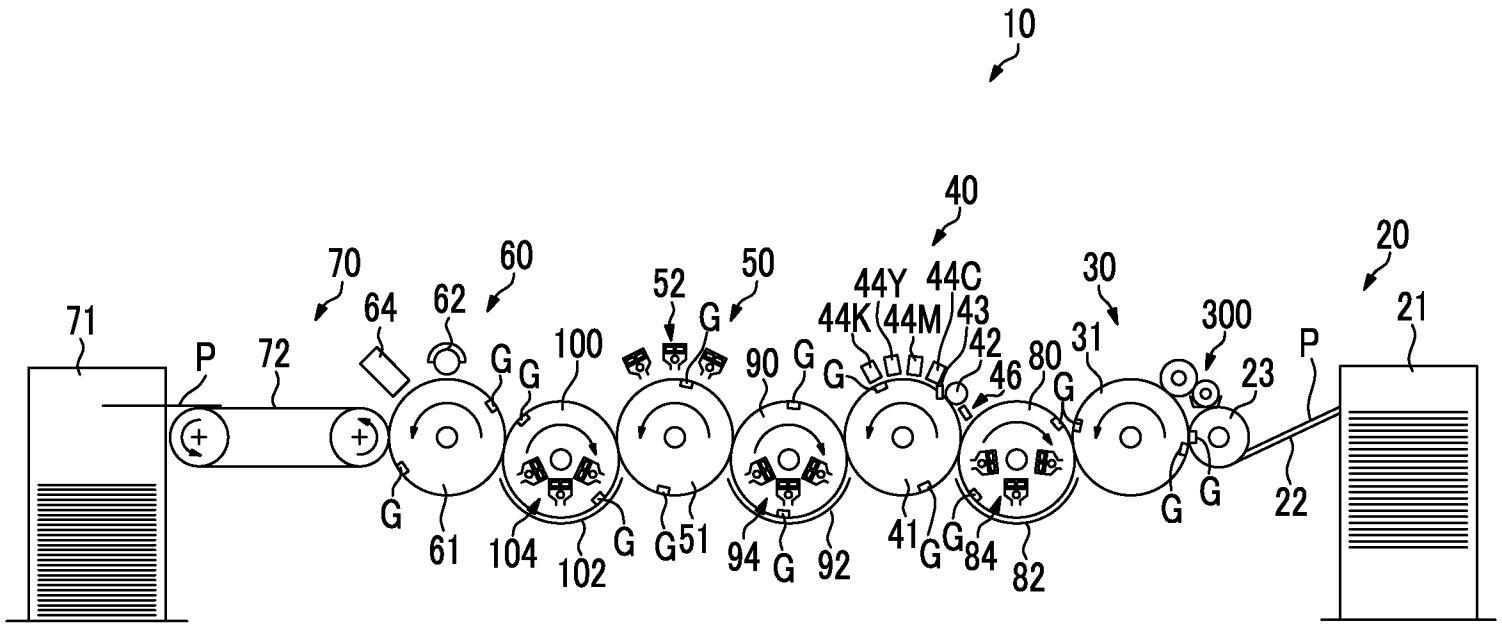
FIG. 1 is an overall configuration diagram showing an embodiment of an inkjet recording apparatus.

FIG. 1 is an overall configuration diagram showing an embodiment of an inkjet recording apparatus according to the invention.

An inkjet recording apparatus 10 is an apparatus which performs printing using aqueous ink (ink in which a color material, such as a dye or a pigment, is dissolved or dispersed in water or a solvent soluble in water) on a sheet P by an inkjet method. The inkjet recording apparatus 10 includes a sheet feed unit 20 which feeds the sheet P, a processing liquid coating unit 30 which coats a predetermined processing liquid on the surface (printing surface) of the sheet P, an image recording unit 40 which ejects ink droplets of the respective colors of cyan (C), magenta (M), yellow (Y), and black (K) onto the printing surface of the sheet P by the inkjet head to draw a color image, an ink drying unit 50 which dries the ink droplets ejected onto the sheet P, a fixing unit 60 which fixes the image recorded on the sheet P, and a recovery unit 70 which recovers the sheet P.

The processing liquid coating unit 30, the image recording unit 40, the ink drying unit 50, and the fixing unit 60 respectively include transport drums 31, 41, 51, and 61 as transport means of the sheet P. The sheet P is transported to the processing liquid coating unit 30, the image recording unit 40, the ink drying unit 50, and the fixing unit 60 by the transport drums 31, 41, 51, and 61.

The transport drums 31, 41, 51, and 61 are formed in a cylindrical shape and corresponding to the sheet width of the sheet P to be printed. Accordingly, when printing is performed on sheets P of different sizes, the transport drums are formed corresponding to a sheet P of maximum size.

Each of the transport drums 31, 41, 51, and 61 is driven by a motor (not shown) to rotate (in FIG. 1, rotates in a counterclockwise direction). The sheet P is wound around the outer circumferential surface of each of the transport drums 31, 41, 51, and 61 and transported.

Grippers are provided as gripping means of the sheet P in the circumferential surface of each of the transport drums 31, 41, 51, and 61. The sheet P is transported in a state where the leading end portion thereof is gripped by the grippers. In this example, grippers G are provided at two locations of the circumferential surface of each of the transport drums 31, 41, 51, and 61. The grippers G are provided at an interval of 180°. Accordingly, two sheets can be transported by single rotation.

Each of the transport drums 31, 41, 51, and 61 is provided with an absorbing and holding mechanism which absorbs and holds the sheet P wound around the outer circumferential surface thereof. In this example, the sheet P is absorbed and held on the outer circumferential surface using air pressure (negative pressure). For this reason, multiple absorption holes are formed in the outer circumferential surface of each of the transport drums 31, 41, 51, and 61. The sheet P is absorbed and held on the outer circumferential surface of each of the transport drums 31, 41, 51, and 61 in a state where the rear surface thereof is sucked from the absorption holes. As the absorbing and holding mechanism, a method (a so-called electrostatic absorption method) using static electricity may be used.

Transfer cylinders 80, 90, and 100 are respectively provided as intermediate transport means between the processing liquid coating unit 30 and the image recording unit 40, between the image recording unit 40 and the ink drying unit 50, and between the ink drying unit 50 and the fixing unit 60. The sheet P is transported between the respective units by the transfer cylinders 80, 90, and 100.

Each of the transfer cylinders 80, 90, and 100 is constituted by a cylindrical frame body and is formed corresponding to the sheet width. Each of the transfer cylinders 80, 90, and 100 is driven by a motor (not shown) to rotate (in FIG. 1, rotates in a clockwise direction).

Grippers G are provided as gripping means of the sheet P on the circumferential surface of each of the transfer cylinders 80, 90, and 100. The sheet P is transported in a state where the leading end portion thereof is gripped by the grippers G. In this example, the grippers G are provided at two locations in the outer circumferential portion of each of the transfer cylinders 80, 90, and 100. The grippers G are provided at an interval of 180°. Accordingly, two sheets can be transported by single rotation.

Arc-like guide plates 82, 92, and 102 are respectively provided below the transfer cylinders 80, 90, and 100 along the transport path of the sheet P. The sheet P to be transported by the transfer cylinders 80, 90, and 100 is transported while the rear surface (the surface opposite to the printing surface) thereof is guided by the guide plates 82, 92, and 102.

Dryers 84, 94, and 104 which blow hot air toward the sheet P to be transported by the transfer cylinders 80, 90, and 100 are provided inside the transfer cylinders 80, 90, and 100 (in this example, three dryers are provided along the transport path of the sheet P). In the sheet P to be transported by the transfer cylinders 80, 90, and 100, hot air blown from the dryers 84, 94, and 104 is blown against the printing surface during a transport process. Accordingly, the sheet P can be subjected to dry processing during the transport process by the transfer cylinders 80, 90, and 100.

The dryers 84, 94, and 104 may have a configuration in which heat is radiated from an infrared heater (so-called heating by radiation) for heating, instead of a configuration in which hot air is blown for heating.

The sheet P fed from the sheet feed unit 20 is transported in an order of the transport drum 31→the transfer cylinder 80→the transport drum 41→the transfer cylinder 90→the transport drum 51→the transfer cylinder 100→the transport drum 61, and is finally recovered by the recovery unit 70. Until the sheet P is recovered from the sheet feed unit 20 by the recovery unit 70, the sheet P is subjected to required processing, and an image is recorded on the printing surface.

Hereinafter, the configuration of each unit of the inkjet recording apparatus 10 of this embodiment will be described in detail.

<Sheet Feed Unit>

The sheet feed unit 20 feeds the sheets P periodically one by one. The sheet feed unit 20 includes a sheet feed device 21, a sheet feed tray 22, and a transfer cylinder 23.

The sheet feed device 21 feeds the sheets P stacked in a magazine (not shown) one by one from the top to the sheet feed tray 22.

The sheet feed tray 22 sends the sheet P fed from the sheet feed device 21 toward the transfer cylinder 23.

The transfer cylinder 23 receives the sheet P sent from the sheet feed tray 22, rotates, and transfers the sheet P to the transport drum 31 of the processing liquid coating unit 30.

The sheet P is not particularly limited, and a general-purpose sheet (a sheet primarily containing cellulose, such as so-called high-quality sheet, a coated sheet, or an art sheet) for use in general offset printing or the like may be used. In this example, a coated sheet is used. A coated sheet has a coated layer which is provided by coating a coat material on the surface of a high-quality sheet, a neutralized sheet, or the like not subjected to a surface treatment. Specifically, an art sheet, a coated sheet, a slightly coated sheet, or the like is suitably used.

If printing is performed on a general-purpose printing sheet by an inkjet method, smearing or the like occurs, and quality of an image is damaged. Accordingly, in order to prevent this failure, in the inkjet recording apparatus 10 of this embodiment, in the subsequent processing liquid coating unit 30, a predetermined processing liquid is coated on the printing surface of the sheet P.

<Processing Liquid Coating Unit>

The processing liquid coating unit 30 coats a predetermined processing liquid on the printing surface of the sheet P. The processing liquid coating unit 30 includes a transport drum (hereinafter, referred to as "processing liquid coating drum") 31 which serves as a transport unit transporting the sheet P, and a coating apparatus 300 which coats a predetermined processing liquid on the printing surface of the sheet P to be transported by the processing liquid coating drum 31.

The processing liquid coating drum 31 receives the sheet P from the transfer cylinder 23 of the sheet feed unit 20 (receives the sheet P while gripping the leading end of the sheet P by the grippers G), and rotates to transport the sheet P along a predetermined transport path. In this case, the transport path of the sheet P is formed along the upper arc of the processing liquid coating drum 31.

The coating apparatus 300 roller-coats a predetermined processing liquid on the printing surface of the sheet P to be transported by the processing liquid coating drum 31. That is, a coating roller with the processing liquid on the circumferential surface thereof is pressed into contact with the printing surface of the sheet P to be transported by the processing liquid coating drum 31, and coats the processing liquid on the printing surface of the sheet P. The configuration of the coating apparatus 300 will be described below in detail.

The processing liquid (coating liquid) to be coated by the coating apparatus 300 is constituted by a liquid which contains an aggregating agent having a function of aggregating a color material component in ink.

Examples of the aggregating agent include a compound which can change pH of an ink composition, multivalent metal salt, or polyallylamines.

Preferred examples of the compound which can decrease pH include high water-soluble acid materials (phosphoric acids, oxalic acids, malonic acids, citric acids, derivatives of compounds thereof, salts, or the like). The acid materials may be used alone, or two or more acid materials may be used in combination. Accordingly, aggregability can increase, and entire ink can be immobilized.

It is preferable that pH (25° C.) of the ink composition is equal to or greater than 8.0, and pH (25° C.) of the processing liquid is in a range of 0.5 to 4. Accordingly, image density, resolution, and high-speed inkjet recording can be achieved.

The processing liquid can contain additives. For example, the processing liquid can contain known additives, such as a drying preventing agent (wetting agent), a discoloration preventing agent, an emulsion stabilizer, a penetration enhancing agent, an ultraviolet absorbing agent, an antiseptic agent, an antifungal agent, a pH adjuster, a surface tension adjuster, an antifoaming agent, a viscosity adjuster, a dispersing agent, a dispersion stabilizer, a corrosion inhibitor, a chelating agent, and the like.

The processing liquid is coated on the printing surface of the sheet P in advance, and printing is performed, whereby it is possible to prevent the occurrence of feathering, bleeding, or the like, and even if a general-purpose printing sheet is used, it becomes possible to perform high-quality printing.

In the processing liquid coating unit 30 having the above-described configuration, the sheet P is held by the processing liquid coating drum 31 and transported along a predetermined transport path (in this case, the transport path is formed along the upper arc of the processing liquid coating drum 31). The processing liquid is coated on the printing surface by the coating apparatus 300 during the transport process.

The sheet P with the processing liquid coated on the printing surface is transferred from the processing liquid coating drum 31 to the transfer cylinder 80 at a predetermined position and transferred from the transfer cylinder 80 to the transport drum 41 of the image recording unit 40.

As described above, the dryer 84 is provided inside the transfer cylinder 80, and hot air is blown toward the guide plate 82. Hot air is blown against the printing surface while the sheet P is being transported from the processing liquid coating unit 30 to the image recording unit 40 by the transfer cylinder 80, and the processing liquid coated on the printing surface is dried (a solvent component in the processing liquid is evaporated and removed).

<Image Recording Unit>

The image recording unit 40 ejects ink droplets of respective colors of C, M, Y, and K onto the printing surface of the sheet P, and draws a color image on the printing surface of the sheet P. The image recording unit 40 includes a transport drum (hereinafter, "image recording drum") 41 which transports the sheet P, a pressing roller 42 which presses the printing surface of the sheet P and brings the rear surface of the sheet P into close contact with the circumferential surface of the image recording drum 41, a sheet floating detection sensor 43 which detects floating of the sheet P, inkjet heads 44C, 44M, 44Y, and 44K which eject ink droplets of the respective colors of C, M, Y, and K onto the sheet P to draw an image, and a back tension applying device 46 which applies back tension to the sheet P wound around the image recording drum 41.

The image recording drum 41 receives the sheet P from the transfer cylinder 80 (receives the sheet P while gripping the leading end of the sheet P by the grippers G), and rotates to transport the sheet P along a predetermined transport path.

The pressing roller 42 is constituted by a rubber roller (a roller in which at least the outer circumferential portion is constituted by rubber (elastic body)) substantially having the same width as the width of the image recording drum 41, and is arranged near a sheet reception position of the image recording drum 41 (a position where the sheet P is received from the transfer cylinder 80). The sheet P transferred from the transfer cylinder 80 to the image recording drum 41 is pressed by the pressing roller 42 from the surface thereof, and then the rear surface thereof is brought into close contact with and wound around the outer circumferential surface of the image recording drum 41.

The sheet floating detection sensor 43 detects floating of the sheet P having passed through the pressing roller 42 (detects a given level or more of floating from the outer circumferential surface of the image recording drum 41). The sheet floating detection sensor 43 is constituted by a laser projector which projects laser light, and a laser receiver which receives laser light.

The laser projector projects laser light parallel to the axis of the image recording drum 41 from one end of the image recording drum 41 toward the other end at a position (a position having upper limit height in an allowable floating range) having predetermined height from the outer circumferential surface of the image recording drum 41.

The laser receiver is arranged to face the laser projector with a traveling path of the sheet P by the image recording drum 41 interposed therebetween, and receives laser light projected from the laser projector.

If floating equal to or greater than an allowable value occurs in the sheet P to be transported by the image recording drum 41, laser light projected from the laser projector is blocked by the sheet P. As a result, the amount of laser light to be received by the laser receiver decreases. The sheet floating detection sensor 43 detects the amount of laser light to be received by the laser receiver to detect floating of the sheet P. That is, the amount of laser light to be received by the laser receiver is compared with a threshold value, and when the amount of laser light is equal to or smaller than the threshold value, it is determined that floating (floating equal to or greater than the allowable value) occurs.

If floating equal to or greater than the allowable value is detected, the rotation of the image recording drum 41 is stopped, and the transport of the sheet P is stopped.

The sheet floating detection sensor 43 is configured so as to adjust the height (the height from the outer circumferential surface of the image recording drum 41) of laser light to be projected from the laser projector. Accordingly, it is possible to arbitrarily set the allowable range of floating.

The four inkjet heads 44C, 44M, 44Y, and 44K are arranged at the back of the sheet floating detection sensor 43 at given intervals in the transport direction of the sheet P. Each of the inkjet heads 44C, 44M, 44Y, and 44K is constituted by a line head corresponding to the sheet width, and has a nozzle surface at the lower surface (the surface facing the outer circumferential surface of the image recording drum 41) thereof. The nozzle surface has nozzles (nozzle array) arranged at given pitches in a direction perpendicular to the transport direction of the sheet P. Each of the inkjet heads 44C, 44M, 44Y, and 44K ejects ink droplets from the nozzles toward the image recording drum 41.

Ink which is used in the inkjet recording apparatus 10 of this embodiment is aqueous ultraviolet curable ink, and contains a pigment, polymer particles, and an aqueous polymerizable compound which is polymerized by active energy rays. Aqueous ultraviolet curable ink can be cured by ultraviolet irradiation, is excellent in friction resistance, and has high film strength.

As the pigment, a water-dispersible pigment in which at least a part of the surface is covered with a polymer dispersing agent is used.

As the polymer dispersing agent, a polymer dispersing agent having an acid value of 25 to 1000 (KOHmg/g) is used. Stability of self-dispersion is improved, and aggregability at the time of contact of the processing liquid is improved.

As the polymer particles, self-polymerizable polymer particles having an acid value of 20 to 50 (KOHmg/g) are used. Stability of self-dispersion is improved, and aggregability at the time of contact of the processing liquid is improved.

As the polymerizable compound, a non-ionic or cationic polymerizable compound is preferably used from the viewpoint of the reactions with the aggregating agent, the pigment, and the polymer particles, and a polymerizable compound having solubility in water equal to or greater than 10% by mass (furthermore, equal to or greater than 15% by mass) is preferably used.

Ink contains an initiator which initiates polymerization of a polymerizable compound by active energy rays. In the initiator, a compound which can initiate a polymerization reaction by active energy rays can be appropriately selected and contained, and for example, an initiator (for example, a photopolymerization initiator or the like) which generates active species (radicals, acids, bases, or the like) by radiation, light, or electron rays can be used. The initiator may be contained in the processing liquid, and may be contained in at least one of ink and the processing liquid.

Ink contains 50 to 70% by mass of water. Ink can contain additives. For example, ink can contain known additives, such as a water-soluble organic solvent, a drying preventing agent (wetting agent), a discoloration preventing agent, an emulsion stabilizer, a penetration enhancing agent, an ultraviolet absorbing agent, an antiseptic agent, an antifungal agent, a pH adjuster, a surface tension adjuster, an antifoaming agent, a viscosity adjuster, a dispersing agent, a dispersion stabilizer, a corrosion inhibitor, a chelating agent, and the like.

The back tension applying device 46 absorbs the surface of the sheet P at a position immediately before the sheet P is pressed by the pressing roller 42 (a position immediately before the sheet P enters between the image recording drum 41 and the pressing roller 42), and applies back tension to the sheet P wound around the image recording drum 41. The back tension applying device 46 includes a sheet guide which absorbs the surface of the sheet P over the width direction. The sheet guide includes an absorption surface on which the surface of the sheet P is absorbed, and sucks the sheet P from multiple absorption holes formed in the absorption surface to absorb the sheet P. The sheet P is absorbed on the absorption surface from the surface, and is then transported while the surface is sliding on the absorption surface. Accordingly, back tension is applied. If back tension is applied in the above-described manner, when the sheet P is wound around the image recording drum 41, the sheet P is stretched and wound around the image recording drum 41. Therefore, the sheet P can be wound around the circumferential surface of the image recording drum 41 without causing wrinkling or floating. Since the sheet P is stretched tightly and wound around the image recording drum 41, the sheet P can be wound around the circumferential surface of the image recording drum 41 without causing wrinkling or floating.

In the image recording unit 40 having the above configuration, the sheet P is transported along a predetermined transport path by the image recording drum 41. The sheet P transferred from the transfer cylinder 80 to the image recording drum 41 is nipped by the pressing roller 42 while being applied with back tension by the back tension applying device 46, and is brought into close contact with the outer circumferential surface of the image recording drum 41. Next, the presence/absence of floating is detected by the sheet floating detection sensor 43, and thereafter, ink droplets of the respective colors of C, M, Y, and K are ejected from the inkjet heads 44C, 44M, 44Y, and 44K, and a color image is drawn on the printing surface.

When floating of the sheet P is detected, the transport is stopped. Therefore, it is possible to prevent the floated sheet P from coming into contact with the nozzle surfaces of the inkjet heads 44C, 44M, 44Y, and 44K.

As described, in the inkjet recording apparatus 10 of this example, aqueous ink is used for all colors. Even when aqueous ink is used, as described above, the processing liquid is coated on the sheet P, and thus, even when a general printing sheet is used, it is possible to perform high-quality printing.

The sheet P on which an image is drawn is transferred to the transfer cylinder 90. The sheet P is transported along a predetermined transport path by the transfer cylinder 90 and transferred to the transport drum 51 of the ink drying unit 50.

In this case, as described above, the dryer 94 is provided inside the transfer cylinder 90, and blows hot air toward the guide plate 92. Although Ink drying processing is performed by the subsequent ink drying unit 50, the sheet P is also subjected to drying processing during the transport by the transfer cylinder 90.

Though not shown, a maintenance unit which performs maintenance of the inkjet heads 44C, 44M, 44Y, and 44K is provided in the image recording unit 40, and the inkjet heads 44C, 44M, 44Y, and 44K are configured to be moved to the maintenance unit as necessary and subjected to required maintenance.

<Ink Drying Unit>

The ink drying unit 50 dries a liquid component which remains in the sheet P after image recording. The ink drying unit 50 includes a transport drum (hereinafter, referred to as "ink drying drum") 51 which transports the sheet P, and an ink drying device 52 which performs drying processing on the sheet P to be transported by the ink drying drum 51.

The ink drying drum 51 receives the sheet P from the transfer cylinder 90 (receives the sheet P while gripping the leading end of the sheet P by the grippers G), and rotates to transport the sheet P along a predetermined transport path.

The ink drying device 52 is constituted by, for example, dryers (in this example, three dryers provided along the transport path of the sheet P), and blows hot air (for example, 80° C.) toward the sheet P to be transported by the ink drying drum 51.

In the ink drying unit 50 having the above configuration, the sheet P is transported along a predetermined transport path by the ink drying drum 51. Then, hot air is blown from the ink drying device 52 against the printing surface during the transport process, and ink applied to the printing surface is dried (a solvent component is evaporated and removed).

The sheet P having passed through the ink drying device 52 is then transferred from the ink drying drum 51 to the transfer cylinder 100 at a predetermined position. The sheet P is transported along a predetermined transport path by the transfer cylinder 100 and transferred to the transport drum 61 of the fixing unit 60.

As described above, the dryer 104 is provided inside the transfer cylinder 100, and blows hot air toward the guide plate 102. Accordingly, the sheet P is also subjected to drying processing during the transport in the transfer cylinder 100.

<Fixing Unit>

The fixing unit 60 heats and presses the sheet P to fix the image recorded on the printing surface. The fixing unit 60 includes a transport drum (hereinafter, referred to as "fixing drum") 61 which transports the sheet P, an ultraviolet irradiation light source 62 which exposes ultraviolet rays to the printing surface of the sheet P, and an in-line sensor 64 which detects the temperature, humidity, and the like of the sheet P after printing and captures the printed image.

The fixing drum 61 receives the sheet P from the transfer cylinder 100 (receives the sheet P while gripping the leading end of the sheet P by the grippers G), and rotates to transport the sheet P along a predetermined transport path.

The ultraviolet irradiation light source 62 irradiates ultraviolet rays onto the printing surface of the sheet P to be transported by the fixing drum 61, and solidifies the aggregate of the processing liquid and ink.

The in-line sensor 64 includes a thermometer, a hygrometer, a CCD line sensor, and the like, detects the temperature, humidity, and the like of the sheet P to be transported by the fixing drum 61, and reads the image printed on the sheet P. Device abnormality, defective head ejection, or the like is checked on the basis of the detection result of the in-line sensor 64.

In the fixing unit 60 having the above configuration, the sheet P is transported along a predetermined transport path by the fixing drum 61. Then, ultraviolet rays are irradiated onto the printing surface from the ultraviolet irradiation light source 62 during the transport process, and the aggregate of the processing liquid and ink is solidified.

The sheet P subjected to the fixing processing is then transferred from the fixing drum 61 to the recovery unit 70 at a predetermined position.

<Recovery Unit>

The recovery unit 70 recovers the sheets P subjected to a series of printing processing in the form of being stacked in a stacker 71. The recovery unit 70 includes the stacker 71 which recovers the sheet P, and a sheet discharge conveyer 72 which receives the sheet P subjected to the fixing processing in the fixing unit 60 from the fixing drum 61, transports the sheet P along a predetermined transport path, and discharges the sheet P to the stacker 71.

The sheet P subjected to the fixing processing in the fixing unit 60 is transferred from the fixing drum 61 to the sheet discharge conveyer 72, transported to the stacker 71 by the sheet discharge conveyer 72, and recovered in the stacker 71.

<<Control System>>

Figure 2:
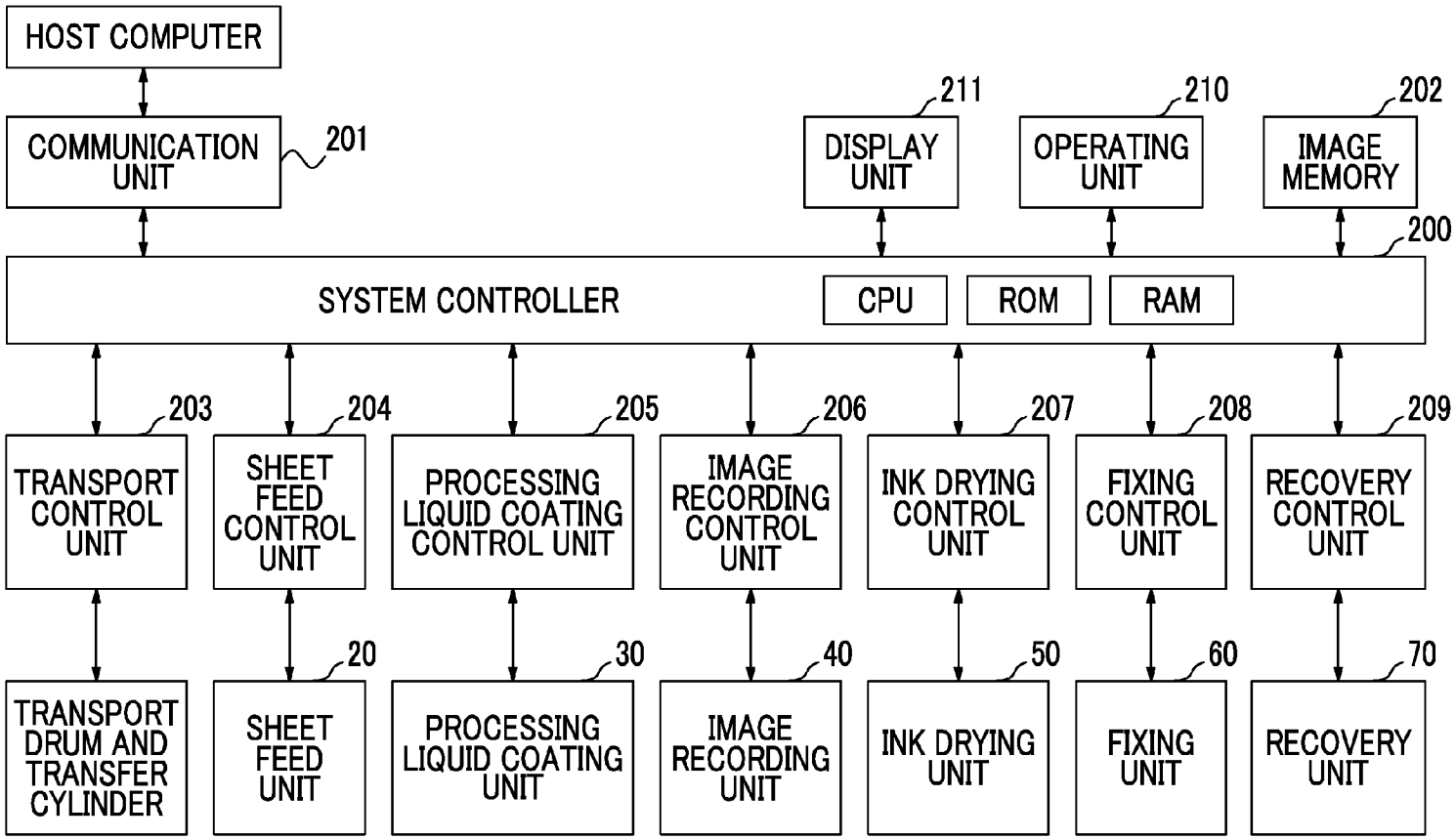
FIG. 2 is a block diagram showing the schematic configuration of a control system of an inkjet recording apparatus.

FIG. 2 is a block diagram showing the schematic configuration of a control system of the inkjet recording apparatus of this embodiment.

As shown in FIG. 2, the inkjet recording apparatus 10 includes a system controller 200, a communication unit 201, an image memory 202, a transport control unit 203, a sheet feed control unit 204, a processing liquid coating control unit 205, an image recording control unit 206, an ink drying control unit 207, a fixing control unit 208, a recovery control unit 209, an operating unit 210, a display unit 211, and the like.

The system controller 200 functions as control means for performing overall control of the respective units of the inkjet recording apparatus 10, and also functions as arithmetic means for performing various kinds of arithmetic processing. The system controller 200 includes a CPU, a ROM, a RAM, and the like, and operates in accordance with a predetermined control program. The ROM stores the control program which is executed by the system controller 200 or various kinds of data necessary for control.

The communication unit 201 includes a required communication interface, and performs data transmission/reception with a host computer connected to the communication interface.

The image memory 202 functions as temporary storage means of various kinds of data including image data, and data reading/writing is performed with respect to the image memory 202 through the system controller 200. Image data read from the host computer through the communication unit 201 is stored in the image memory 202.

The transport control unit 203 controls the driving of the transport drums 31, 41, 51, and 61 and the transfer cylinders 80, 90, and 100 as transport means of the sheet P in the respective units of the processing liquid coating unit 30, the image recording unit 40, the ink drying unit 50, and the fixing unit 60.

That is, the transport control unit 203 controls the driving of the motor which drives each of the transport drums 31, 41, 51, and 61 and also controls the opening/closing of the grippers G provided in each of the transport drums 31, 41, 51, and 61.

Similarly, the transport control unit 203 controls the driving of the motor which drives each of the transfer cylinders 80, 90, and 100, and also controls the opening/closing of the grippers G provided in the transfer cylinders 80, 90, and 100.

Since the absorbing and holding mechanism which absorbs and holds the sheet P on the circumferential surface is provided in each of the transport drums 31, 41, 51, and 61, the transport control unit 203 controls the driving of the absorbing and holding mechanism (In this embodiment, since the sheet P is absorbed in vacuum, the transport control unit 203 controls the driving of a vacuum pump as negative pressure generation means).

Since the dryers 84, 94, and 104 are respectively provided in the transfer cylinders 80, 90, and 100, the transport control unit 203 controls the driving (the amount of heating and the amount of air blow) of the dryers 84, 94, and 104.

The driving of the transport drums 31, 41, 51, and 61 and the driving of the transfer cylinders 80, 90, and 100 are controlled in response to commands from the system controller 200.

The sheet feed control unit 204 controls the driving of the respective units (the sheet feed device 21, the transfer cylinder 23, and the like) constituting the sheet feed unit 20 in response to commands from the system controller 200.

The processing liquid coating control unit 205 controls the driving of the respective units (the coating apparatus 300 and the like) constituting the processing liquid coating unit 30 in response to commands from the system controller 200.

The image recording control unit 206 controls the driving of the respective units (the pressing roller 42, the sheet floating detection sensor 43, the inkjet heads 44C, 44M, 44Y, and 44K, the back tension applying device 46, and the like) constituting the image recording unit 40 in response to commands from the system controller 200.

The ink drying control unit 207 controls the driving of the respective units (the ink drying device 52 and the like) constituting the ink drying unit 50 in response to commands from the system controller 200.

The fixing control unit 208 controls the driving of the respective units (the ultraviolet irradiation light source 62, the in-line sensor 64, and the like) constituting the fixing unit 60 in response to commands from the system controller 200.

The recovery control unit 209 controls the driving of the respective units (the sheet discharge conveyer 72 and the like) constituting the recovery unit 70 in response to commands from the system controller 200.

The operating unit 210 includes required operating means (for example, operating buttons, a keyboard, a touch panel, and the like), and outputs operation information input from the operating means to the system controller 200. The system controller 200 executes various kinds of processing in accordance with the operation information input from the operating unit 210.

The display unit 211 includes a required display device (for example, an LCD panel or the like), and displays required information on the display device in response to a command from the system controller 200.

As described above, image data to be recorded on a sheet is read from the host computer to the inkjet recording apparatus 10 through the communication unit 201, and stored in the image memory 202. The system controller 200 performs required signal processing on image data stored in the image memory 202 to generate dot data, and controls the driving of each inkjet head of the image recording unit 40 in accordance with generated dot data, thereby recording an image represented by the image data on the sheet.

In general, dot data is generated by performing color conversion processing and halftone processing on image data. The color conversion processing is processing for converting image data (for example, RGB 8-bit image data) expressed sRGB or the like to ink amount data of the respective colors of ink to be used in the inkjet recording apparatus 10 (in this example, converting image data to image amount data of the respective colors of C, M, Y, and K). The halftone processing is processing for performing processing, such as error diffusion, image amount data of the respective units generated by the color conversion processing to convert image amount data to dot data of the respective colors.

The system controller 200 performs color conversion processing and halftone processing on image data to generate dot data of the respective colors. The system controller 200 controls the driving of the inkjet heads in accordance with the generated dot data of the respective colors, and records an image represented by image data on the sheet.

<<Printing Operation>>

Next, a printing operation by the inkjet recording apparatus 10 will be described roughly.

If a sheet feed command is output from the system controller 200 to the sheet feed device 21, the sheet P is fed from the sheet feed device 21 to the sheet feed tray 22. The sheet P fed to the sheet feed tray 22 is transferred to the processing liquid coating drum 31 of the processing liquid coating unit 30 through the transfer cylinder 23.

The sheet P transferred to the processing liquid coating drum 31 is transported along a predetermined transport path by the processing liquid coating drum 31, and the processing liquid is coated on the printing surface by the coating apparatus 300 during the transport process.

The sheet P with the processing liquid coated thereon is transferred from the processing liquid coating drum 31 to the transfer cylinder 80. Then, the sheet P is transported along a predetermined transport path by the transfer cylinder 80 and transferred to the image recording drum 41 of the image recording unit 40. Hot air is blown from the dryer 84 provided inside the transfer cylinder 80 to the printing surface of the sheet P during the transport process by the transfer cylinder 80, and the processing liquid coated on the printing surface is dried.

The sheet P transferred from the transfer cylinder 80 to the image recording drum 41 is first nipped by the pressing roller 42, and the rear surface thereof comes into close contact with the outer circumferential surface of the image recording drum 41.

For the sheet P having passed through the pressing roller 42, the presence/absence of floating is detected by the sheet floating detection sensor 43. If floating of the sheet P is detected, the transport is stopped. When floating is not detected, the sheet P is transported toward the inkjet heads 44C, 44M, 44Y, and 44K directly. When passing below the inkjet heads 44C, 44M, 44Y, and 44K, ink droplets of the respective colors of C, M, Y, and K are ejected from the inkjet heads 44C, 44M, 44Y, and 44K, and thus a color image is drawn on the printing surface.

The sheet P on which the image is drawn is transferred from the image recording drum 41 to the transfer cylinder 90. The sheet P is transported along a predetermined transport path by the transfer cylinder 90 and transferred to the ink drying drum 51 of the ink drying unit 50. Hot air is blown from the dryer 94 provided inside the transfer cylinder 90 toward the printing surface of the sheet P during the transport process by the transfer cylinder 90, and ink applied to the printing surface is dried.

The sheet P transferred to the ink drying drum 51 is transported along a predetermined transport path by the ink drying drum 51. Then, hot air is blown from the ink drying device 52 against the printing surface during the transport process, and a liquid component which remains on the printing surface is dried.

The sheet P subjected to the drying processing is transferred from the ink drying drum 51 to the transfer cylinder 100. Then, the sheet P is transported along a predetermined transport path by the transfer cylinder 100 and transferred to the fixing drum 61 of the fixing unit 60. Hot air is blown from the dryer 104 provided inside the transfer cylinder 100 against the printing surface of the sheet P during the transport process by the transfer cylinder 100, and ink applied to the printing surface is further dried.

The sheet P transferred to the fixing drum 61 is transported along a predetermined transport path by the fixing drum 61. Then, ultraviolet rays are irradiated onto the printing surface during the transport process, and the drawn image is fixed onto the sheet P. Thereafter, the sheet P is transferred from the fixing drum 61 to the sheet discharge conveyer 72 of the recovery unit 70, transported to the stacker 71 by the sheet discharge conveyer 72, and discharged into the stacker 71.

As described above, in the inkjet recording apparatus 10 of this example, the sheet P is drum-transported, and the processing including coating and drying of the processing liquid and ejection, drying, and fixing of ink droplets is performed on the sheet P during the transport process to record a predetermined image on the sheet P.

<<Details of Coating Apparatus>>

Next, the coating apparatus 300 which is incorporated in the inkjet recording apparatus 10 of this embodiment will be described.

As described above, the coating apparatus 300 coats the processing liquid (liquid to be coated) on the surface of the sheet (object to be coated) P to be transported by the processing liquid coating drum 31.

First Embodiment

<Configuration>

Figure 3:
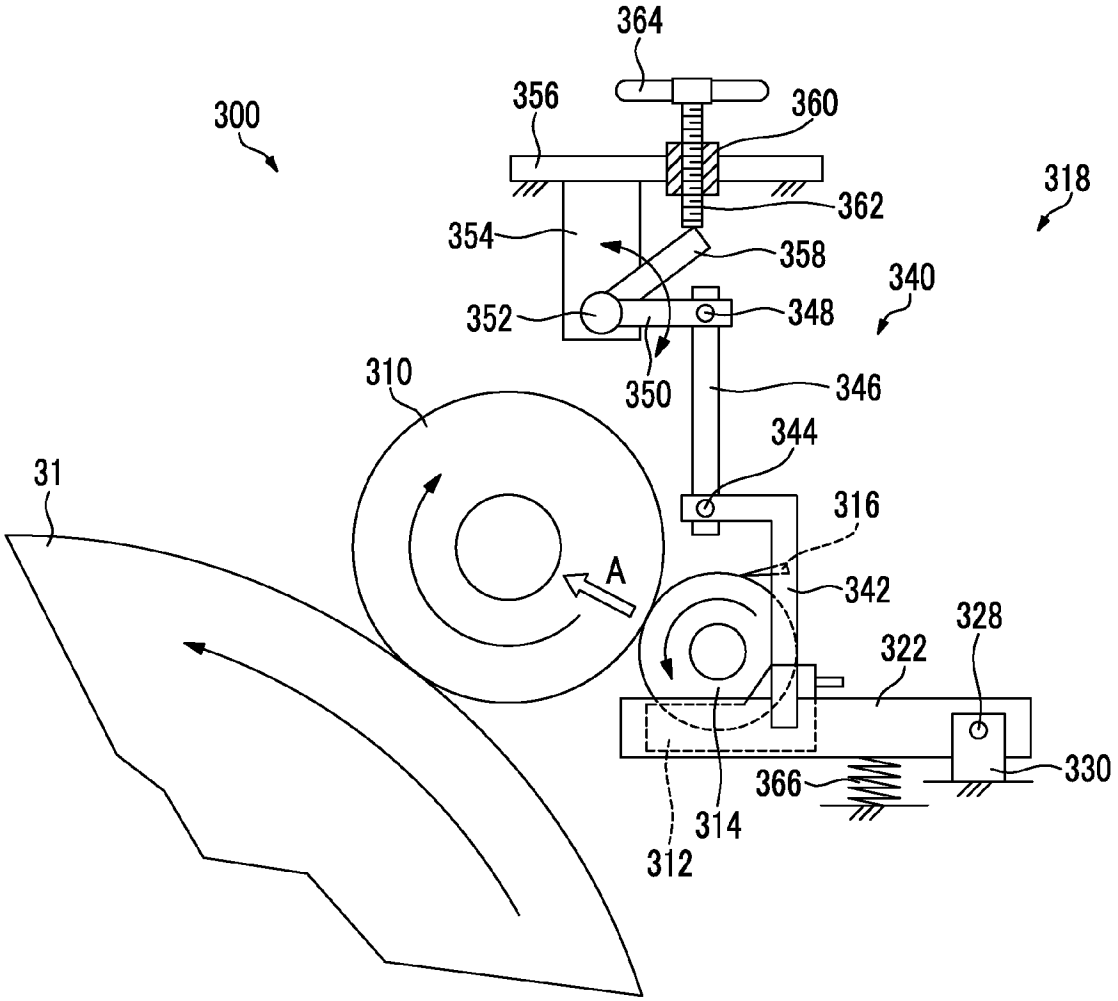
FIG. 3 is a side view showing the configuration of a coating apparatus.

FIG. 3 is a side view showing the configuration of the coating apparatus.

Figure 6:
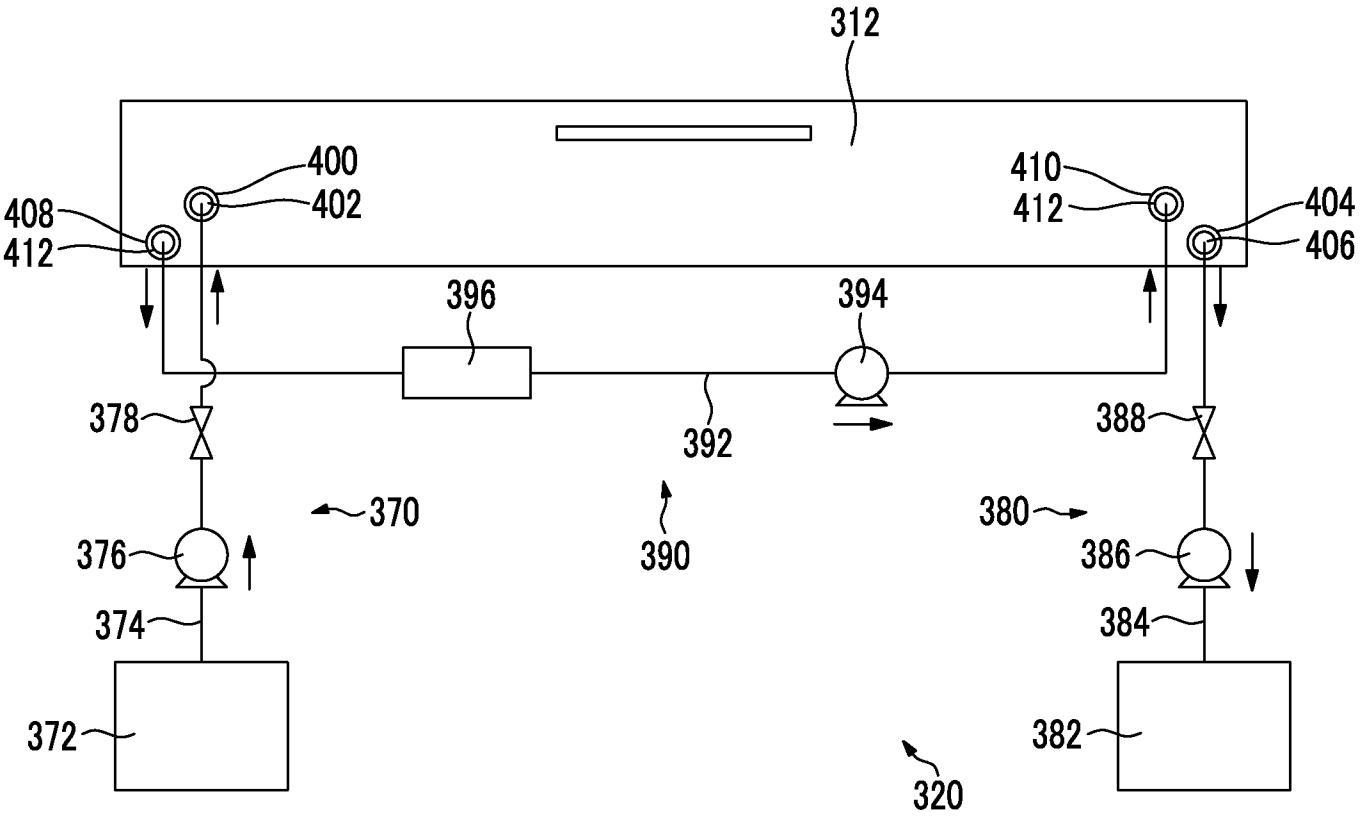
FIG. 6 is a system configuration diagram of a processing liquid supply system.

As shown in FIG. 3, the coating apparatus 300 includes a coating roller 310, a coating liquid pan 312, a coating liquid supply roller 314, a blade 316, a coating liquid pan support mechanism 318, and a processing liquid supply system 320 (see FIG. 6). The coating roller 310 coats the processing liquid as the coating liquid on the sheet P. The coating liquid pan 312 stores the processing liquid which is supplied to the coating roller 310. The coating liquid supply roller 314 draws up the processing liquid stored in the coating liquid pan 312 and supplies the processing liquid to the coating roller 310. The blade 316 scrapes off an excessive processing liquid from the coating liquid supply roller 314 that has drawn up the processing liquid. The coating liquid pan support mechanism 318 supports the coating liquid pan 312 so as to be detached independently. The processing liquid supply system 320 performs the supply, discharge, and circulation of the processing liquid.

The coating apparatus 300 is provided on the transport path of the sheet P by the processing liquid coating drum 31, and brings the coating roller 310 into contact with the surface of the sheet P to be transported by the processing liquid coating drum 31 to coat the processing liquid. In the inkjet recording apparatus 10 of this embodiment, the transport path of the sheet P in the processing liquid coating unit 30 is formed along the upper arc of the processing liquid coating drum 31. Accordingly, the coating apparatus 300 is provided above the processing liquid coating drum 31.

The coating roller 310 is configured so as to substantially have the same width as the processing liquid coating drum 31. The coating roller 310 is assembled in the coating apparatus 300 while both end portions are supported by bearings (not shown). The assembled coating roller 310 is arranged in parallel to the processing liquid coating drum 31.

The bearings (not shown) of the coating roller 310 are provided in a main body frame (not shown) of the coating apparatus 300, and detachably supports the coating roller 310. The main body frame (not shown) of the coating apparatus 300 is provided so as to be fixed to a main body frame (not shown) of the inkjet recording apparatus 10.

The bearings (not shown) of the coating roller 310 are provided so as to freely move forward/backward with respect to the processing liquid coating drum 31, and supports the supported coating roller 310 so as to freely move forward/backward with respect to the processing liquid coating drum 31. The coating roller 310 is driven by a forward/backward driving mechanism (not shown) and is pressed into contact with the circumferential surface of the processing liquid coating drum 31 in conformity with the passage timing of the sheet P. Accordingly, it is possible to coat the processing liquid only on the sheet P. This kind of forward/backward driving mechanism belongs to a known technique (for example, a forward/backward moving mechanism by a cam or the like), and thus, description of the specific configuration thereof will be omitted.

A motor (not shown) as rotational driving means of the coating roller 310 is connected to the coating roller 310 assembled in the coating apparatus 300. The coating roller 310 is driven by the motor to rotate.

The coating liquid pan 312 stores the processing liquid which is supplied to the coating roller 310. The coating liquid pan 312 is formed so as to accommodate the lower end portion of the coating liquid supply roller 314 and is formed so as to have an open upper portion.

As described above, the coating liquid pan 312 is supported by the coating liquid pan support mechanism 318 and assembled in the coating apparatus 300. At this time, the coating liquid pan 312 is supported independently detachably from the coating apparatus 300 without detaching the coating roller 310 or the like from the coating apparatus 300. This point will be described below in detail.

The coating liquid supply roller 314 functions as a roller configured to draw the processing liquid as the coating liquid from the coating liquid pan 312. The coating liquid supply roller 314 is configured so as to substantially have the same width as the coating roller 310. The coating liquid supply roller 314 is constituted by a so-called anilox roller, and draws the processing liquid stored in the coating liquid pan 312 to supply the processing liquid to the coating roller 310.

The coating liquid supply roller 314 is assembled in the coating apparatus 300 while both end portions are supported by bearings (not shown) as a support portion. The coating liquid supply roller 314 supported by the bearings (not shown) is arranged in parallel to the coating roller 310, and the circumferential surface thereof comes into contact with the circumferential surface of the coating roller 310. Accordingly, it is possible to supply (transfer) the processing liquid drawn up from the coating liquid pan 312 to the circumferential surface of the coating roller 310.

As described above, the coating roller 310 moves forward/backward with respect to the processing liquid coating drum 31. At this time, the coating roller 310 moves along the circumferential surface of the coating liquid supply roller 314. That is, the coating roller 310 moves while constantly coming into contact with the circumferential surface of the coating liquid supply roller 314 and moves forward/backward with respect to the processing liquid coating drum 31.

As described above, the coating liquid supply roller 314 draws up the processing liquid stored in the coating liquid pan 312 to supply the processing liquid to the coating roller 310. Accordingly, the coating liquid pan 312 is provided such that the lower end portion of the coating liquid supply roller 314 is immersed in the processing liquid. This point will be described below in detail.

The blade 316 scrapes off an excess processing liquid drawn up by the coating liquid supply roller 314 from the coating liquid supply roller 314, and adjusts the thickness of the processing liquid to be stuck to the surface of the coating liquid supply roller 314 to a given thickness. The blade 316 is formed to substantially have the same width as the coating liquid supply roller 314 and is provided to be in contact with the surface of the coating liquid supply roller 314.

Since it is necessary to adjust the thickness of the processing liquid before being supplied to the coating roller 310, the blade 316 is provided on the upstream side in the rotation direction of the coating liquid supply roller 314 with respect to a contact portion of the coating roller 310 and the coating liquid supply roller 314.

The coating liquid pan support mechanism 318 is a mechanism which supports the coating liquid pan 312 such that the coating liquid pan 312 is provided at a predetermined installation position, and supports the coating liquid pan 312 detachably alone.

The coating liquid pan support mechanism 318 includes a receiving pan 322, and a receiving pan elevating mechanism 340 which moves the receiving pan 322 up and down.

Figure 4:
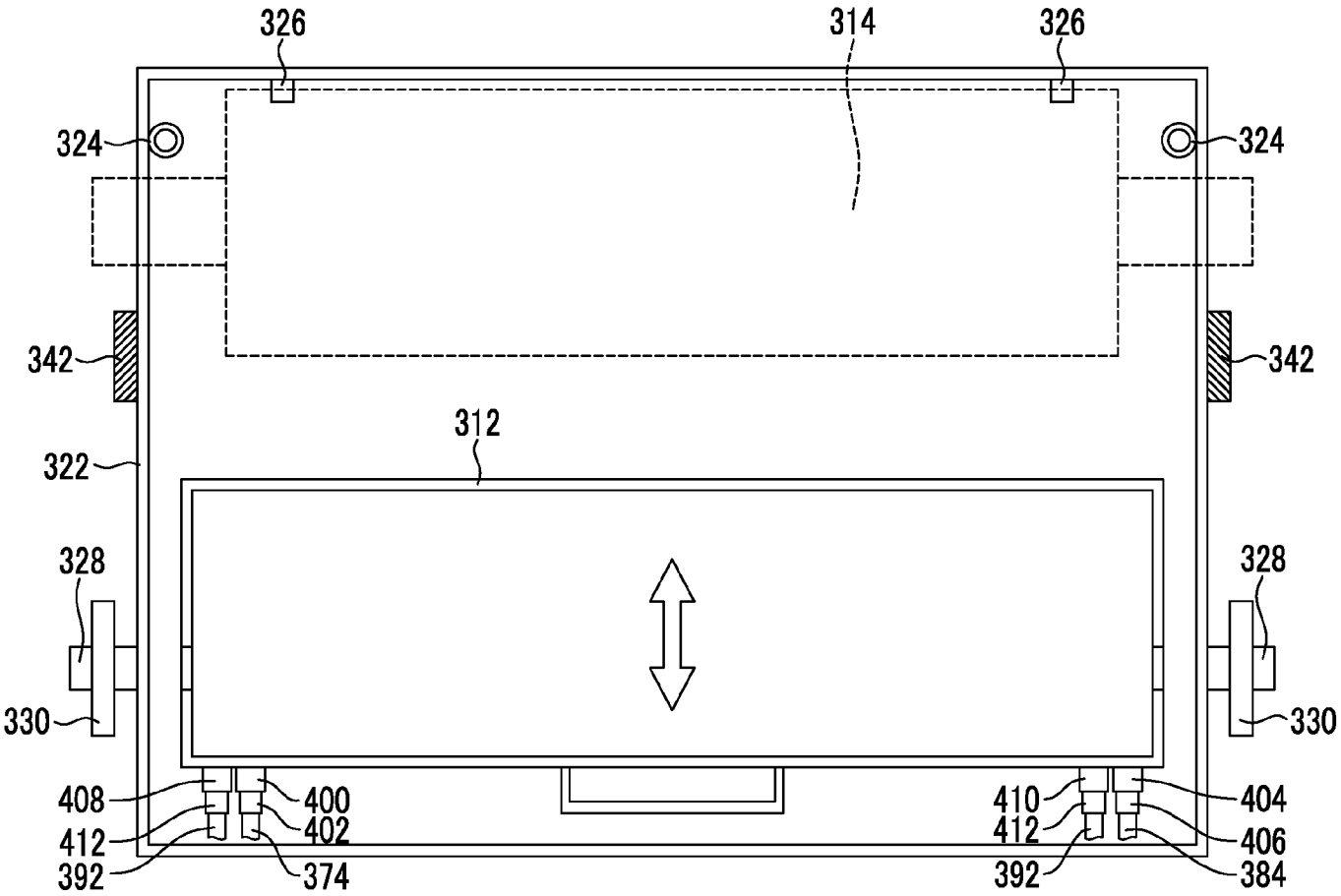
FIG. 4 is a plan view of a receiving pan (a coating liquid pan is at a detachment position).

FIG. 4 is a plan view of the receiving pan 322.

The receiving pan 322 functions as a support unit which slidably supports the coating liquid pan 312, and also has a function as a receiving pan which recovers the processing liquid overflowing from the coating liquid pan 312. The receiving pan 322 is substantially formed to have a rectangular pan shape with an open upper portion. The coating liquid pan 312 is accommodated inside the receiving pan 322.

The bottom surface of the receiving pan 322 is flat. The coating liquid pan 312 accommodated in the receiving pan 322 is supported slidably along the bottom surface of the receiving pan 322.

A pair of guide rollers 324 are arranged inside the receiving pan 322. A pair of guide rollers 324 are arranged on the leading end side of the receiving pan 322 (the coating liquid supply roller 314 side). A pair of guide rollers 324 are provided at an interval conforming to the width of the coating liquid pan 312. The coating liquid pan 312 which slides inside the receiving pan is configured such that the guide rollers 324 come into contact with both lateral surfaces at the position on the leading end side inside the receiving pan, and movement in the width direction is regulated. That is, a pair of guide rollers 324 function as a positioning unit in the width direction of the coating liquid pan 312. The coating liquid pan 312 moves to the leading end side of the receiving pan 322, whereby a pair of guide rollers 324 come into contact with both lateral surfaces thereof, and positioning in the width direction is performed.

A stopper 326 is arranged inside the receiving pan 322. The stopper 326 is arranged in an inner wall surface on the leading end side (the coating liquid supply roller 314 side) of the receiving pan 322. The coating liquid pan 312 which slides inside the receiving pan in the leading end direction is configured such that the stopper 326 comes into contact with the leading end surface (the outer wall surface on the coating liquid supply roller 314 side) thereof, and thus movement in the leading end direction is regulated. That is, the stopper 326 functions as a positioning unit in the front-back direction (slide direction) of the coating liquid pan 312.

The coating liquid pan 312 slides inside the receiving pan toward the leading end side, whereby movement in the width direction is regulated by a pair of guide rollers 324 and positioning in the front-back direction is regulated by the stopper 326. Accordingly, the coating liquid pan 312 is positioned at a predetermined attachment position inside the receiving pan and attached.

This attachment position is set at a position below (substantially directly below) the coating liquid supply roller 314 (see FIG. 5), and is set at a position where, when the receiving pan 322 is moved up and down, the lower end portion of the coating liquid supply roller 314 is immersed in or away from the processing liquid stored in the coating liquid pan 312.

The receiving pan 322 is supported by the main body frame (not shown) of the coating apparatus 300. The receiving pan 322 includes a swing shaft 328 and is supported swingably around the swing shaft 328. The swing shaft 328 is provided in parallel to the axis of the coating liquid supply roller 314, and is provided to protrude from both lateral surfaces of the receiving pan 322. A receiving pan support portion 330 which supports the swing shaft 328 is provided in the main body frame (not shown) of the coating apparatus 300. The receiving pan 322 is swingably supported while the swing shaft 328 is supported by the receiving pan support portion 330. The receiving pan 322 swings around the swing shaft 328 to move up and down (vertical movement).

The swing shaft 328 is arranged on the rear end side of the lateral surface of the receiving pan 322. Accordingly, the leading end side of the receiving pan 322 swings.

The receiving pan elevating mechanism 340 moves the receiving pan 322 up and down to move the coating liquid pan 312 attached to the receiving pan 322 up and down, and moves the receiving pan 322 forward/backward with respect to the coating liquid supply roller 314. That is, the receiving pan elevating mechanism 340 functions as a relative movement unit of the receiving pan 322 which functions as a support unit of the coating liquid pan 312.

As shown in FIG. 3, the receiving pan elevating mechanism 340 swings the receiving pan 322 swingably supported to move the receiving pan 322 up and down.

The receiving pan elevating mechanism 340 includes a pair of elevating arms 342 which extend upward from both lateral surfaces of the receiving pan 322. Each elevating arm 342 is formed bent and connected to a lower end of a connecting arm 346 through a pin 344 in the upper end portion.

The connecting arm 346 is formed in a linear shape and substantially arranged vertically. The connecting arm 346 is connected to a leading end of a swing arm 350 through a pin 348 in the upper end portion.

The swing arm 350 is formed in a rod shape, and a base end portion thereof is fixed to a shaft 352. The shaft 352 is arranged in parallel to the axis of the coating liquid supply roller 314, and both end portions thereof are rotatably supported by a pair of bearing portions 354. A pair of bearing portions 354 are provided in a ceiling frame 356. The ceiling frame 356 is arranged above the coating liquid supply roller 314 and fixed to the main body frame (not shown) of the coating apparatus 300.

A driving arm 358 is provided in the shaft 352. The driving arm 358 has a base end portion fixed to the shaft 352 and is supported by the shaft 352 in a cantilever manner. The driving arm 358 swings to rotate the shaft 352. The shaft 352 rotates to swing the swing arm 350.

A nut portion 360 is provided in the ceiling frame 356. A screw rod 362 is threaded into the nut portion 360. The screw rod 362 has a knob 364 in a head portion thereof. The knob 364 rotates to rotate the screw rod 362, and the screw rod 362 moves vertically with respect to the ceiling frame 356.

The lower end of the screw rod 362 is engaged with the leading end of the driving arm 358, and if the screw rod 362 is moved down, the driving arm 358 is pushed down. As a result, the shaft 352 rotates, and the swing arm 350 swings downward.

The swing arm 350 swings downward, whereby the connecting arm 346 and the elevating arm 342 are pushed down, and the receiving pan 322 is pushed down.

A spring 366 is arranged below the receiving pan 322. The spring 366 is attached to the main body frame (not shown) of the coating apparatus 300, and biases the receiving pan 322 upward.

Accordingly, if the screw rod 362 is rotated by the knob 364 to move the screw rod 362 upward, the receiving pan 322 is pushed up by a biasing force of the spring 366 and moves upward.

In this way, the receiving pan 322 moves up and down by rotating the knob 364 provided in the receiving pan elevating mechanism 340. That is, the receiving pan 322 moves up by rotating the knob 364 in one direction, and moves down by rotating the knob 364 in the other direction.

The receiving pan 322 moves up between a predetermined immersion position and a retraction position, and when the receiving pan 322 is located at the immersion position in a state where the coating liquid pan 312 is located at the attachment position, a part (lower end portion) of the coating liquid supply roller 314 is immersed in the processing liquid stored in the coating liquid pan 312.

When the receiving pan 322 is located at the retraction position, the coating liquid pan 312 is away from the coating liquid supply roller 314. When the coating liquid supply roller 314 is immersed in the processing liquid, it is not possible to detach the coating liquid pan 312. Meanwhile, when the receiving pan 322 is located at the retraction position, the coating liquid supply roller 314 is located above the coating liquid pan 312, whereby the coating liquid pan 312 can slide and can be detached from the receiving pan 322.

Accordingly, the retraction position is set at a position where the coating liquid pan 312 can slide without being brought into contact with the coating liquid supply roller 314.

In the receiving pan elevating mechanism 340, the reason that the elevating arm 342 is formed bent enables the attachment/detachment of the coating liquid supply roller 314. That is, the elevating arm 342 is formed bent so as not to inhibit the attachment/detachment of the coating liquid supply roller 314 when attaching and detaching the coating liquid supply roller 314. Accordingly, the direction in which the elevating arm 342 is bent is set to a direction opposite to the detachment direction (a direction indicated by a white arrow A of FIG. 3) of the coating liquid supply roller 314. That is, the elevating arm 342 is bent such that the attachment/detachment direction of the coating liquid supply roller 314 is opened.

As shown in FIG. 6, the processing liquid supply system 320 includes a supply system (coating liquid supply unit) 370 which supplies the processing liquid to the coating liquid pan 312, a liquid discharge system (waste coating liquid discharge unit) 380 which discharges the processing liquid from the coating liquid pan 312, and a circulation system 390 which circulates the processing liquid stored in the coating liquid pan 312.

As shown in FIG. 6, the supply system 370 includes a processing liquid tank 372 which stores the processing liquid, a supply pipe 374 which connects the processing liquid tank 372 and the coating liquid pan 312, a supply pump 376 which is provided in the supply pipe 374 and sends the processing liquid in the processing liquid tank 372 through the supply pipe 374, and a supply valve 378 which is provided in the supply pipe 374.

The supply valve 378 is opened and the supply pump 376 is driven, whereby the processing liquid is supplied from the processing liquid tank 372 to the coating liquid pan 312 through the supply pipe 374.

Figure 5:
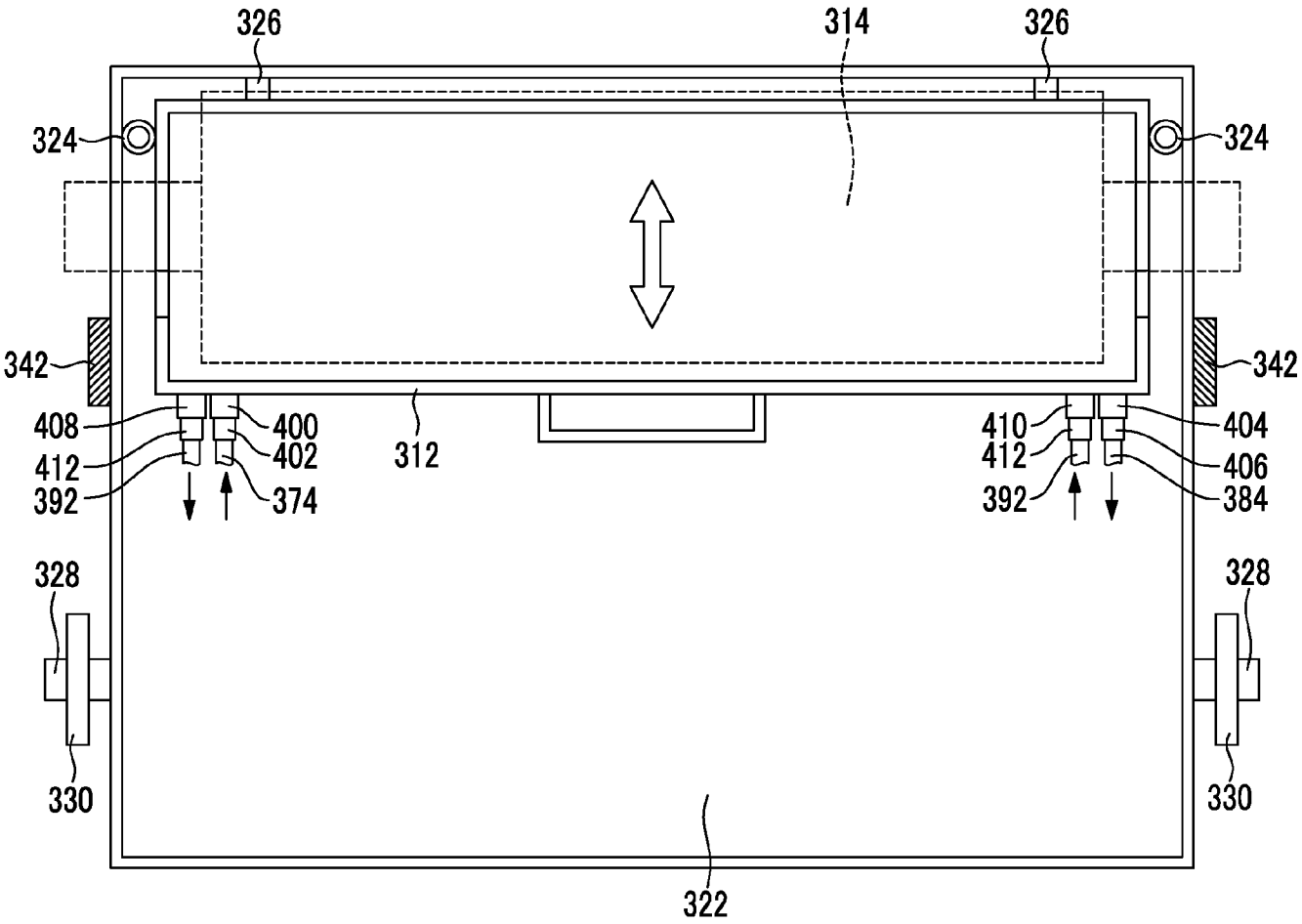
FIG. 5 is a plan view of a receiving pan (a coating liquid pan is at an attachment position).

As shown in FIG. 5, a supply port 400 to which the supply pipe 374 is connected is provided in the coating liquid pan 312. The supply pipe 374 is detachably connected to the supply port 400 through a valved coupling 402. With the use of the valved coupling 402, it is possible to prevent leakage of the processing liquid at the time of attachment and detachment.

As shown in FIG. 6, the liquid discharge system 380 includes a waste liquid discharge tank 382 which stores a waste liquid, a waste liquid discharge pipe 384 which connects the waste liquid discharge tank 382 and the coating liquid pan 312, a waste liquid discharge pump 386 which is provided in the waste liquid discharge pipe 384 and sends the processing liquid from the coating liquid pan 312 to the waste liquid discharge tank 382, and a waste liquid discharge valve 388 which is provided in the waste liquid discharge pipe 384.

The waste liquid discharge valve 388 is opened and the waste liquid discharge pump 386 is driven, whereby the processing liquid is sent from the coating liquid pan 312 to the waste liquid discharge tank 382 through the waste liquid discharge pipe 384.

As shown in FIG. 5, a waste liquid discharge port 404 to which the waste liquid discharge pipe 384 is connected is provided in the coating liquid pan 312. The waste liquid discharge pipe 384 is detachably connected to the waste liquid discharge port 404 through a valved coupling 406. With the use of the valved coupling 406, it is possible to prevent leakage of the processing liquid at the time of attachment and detachment.

The supply port 400 is provided at one end (first end portion) in the width direction of the coating liquid pan 312, and the waste liquid discharge port 404 is provided at the other end (second end portion) in the width direction of the coating liquid pan 312. That is, the supply port 400 and the waste liquid discharge port 404 are provided such that the processing liquid is supplied from one end in the width direction of the coating liquid pan 312 and discharged from the other end.

As shown in FIG. 6, the circulation system 390 includes a circulation pipe 392, a circulation pump 394 which is provided in the circulation pipe 392, and a filter 396 which is provided in the circulation pipe 392.

As shown in FIG. 5, a circulation supply port 408 and a circulation recovery port 410 to which the circulation pipe 392 is connected are provided in the coating liquid pan 312. The circulation supply port 408 is provided at one end in the width direction of the coating liquid pan 312, and the circulation recovery port 410 is provided at the other end in the width direction of the coating liquid pan 312. The circulation pipe 392 is detachably connected to the circulation supply port 408 and the circulation recovery port 410 through a valved coupling 412. With the use of the valved coupling 412, it is possible to prevent leakage of the processing liquid at the time of attachment and detachment.

The circulation pump 394 is driven, whereby the processing liquid stored in the coating liquid pan 312 is circulated through the circulation pipe 392. Accordingly, it is possible to prevent the processing liquid stored in the coating liquid pan 312 from being concentrated.

The filter 396 removes a foreign substance from the processing liquid flowing through the circulation pipe 392. Accordingly, it is possible to maintain the processing liquid stored in the coating liquid pan 312 clean.

<Action>

Next, the action of the coating apparatus 300 of this embodiment configured as above will be described.

As described above, in the coating apparatus 300 of this embodiment, it is possible to attach and detach the coating liquid pan 312 separately without detaching the coating roller or the like.

First, a case of attaching the coating liquid pan 312 will be described.

Figure 7:
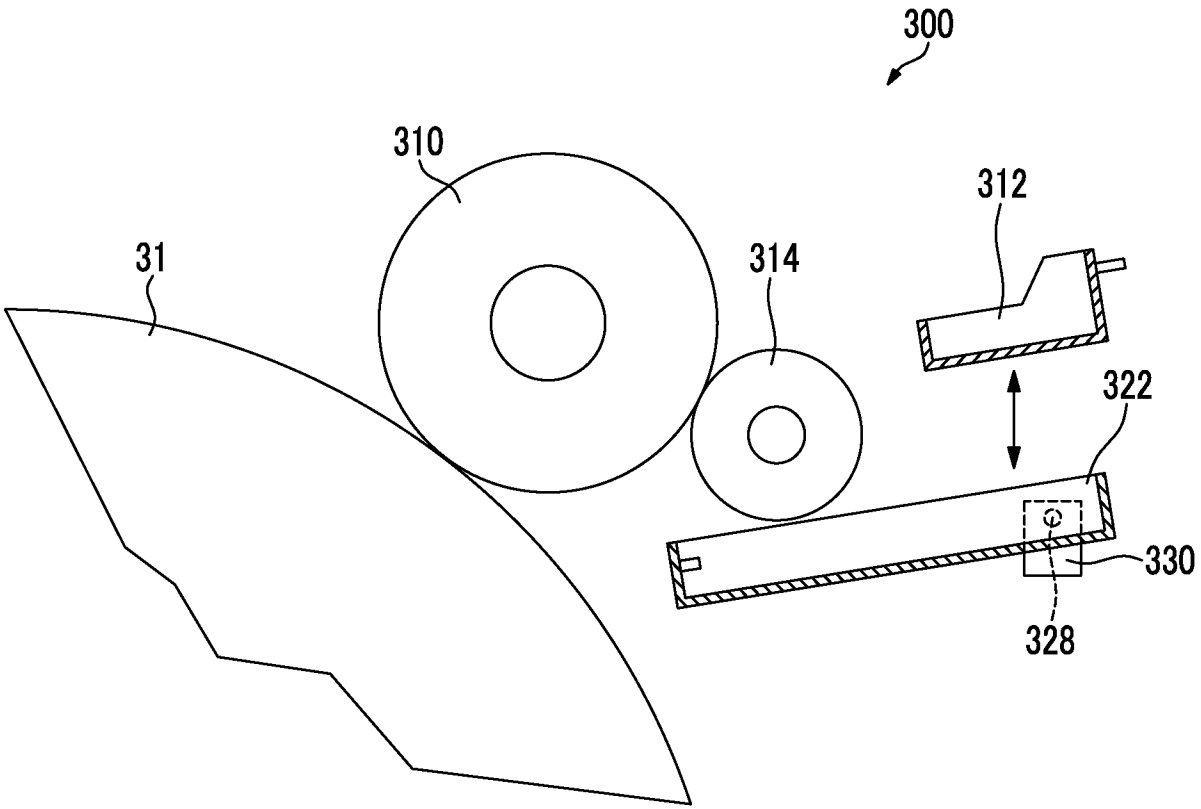
FIG. 7 is an explanatory view of a coating liquid pan attachment and detachment method.
Figure 8:
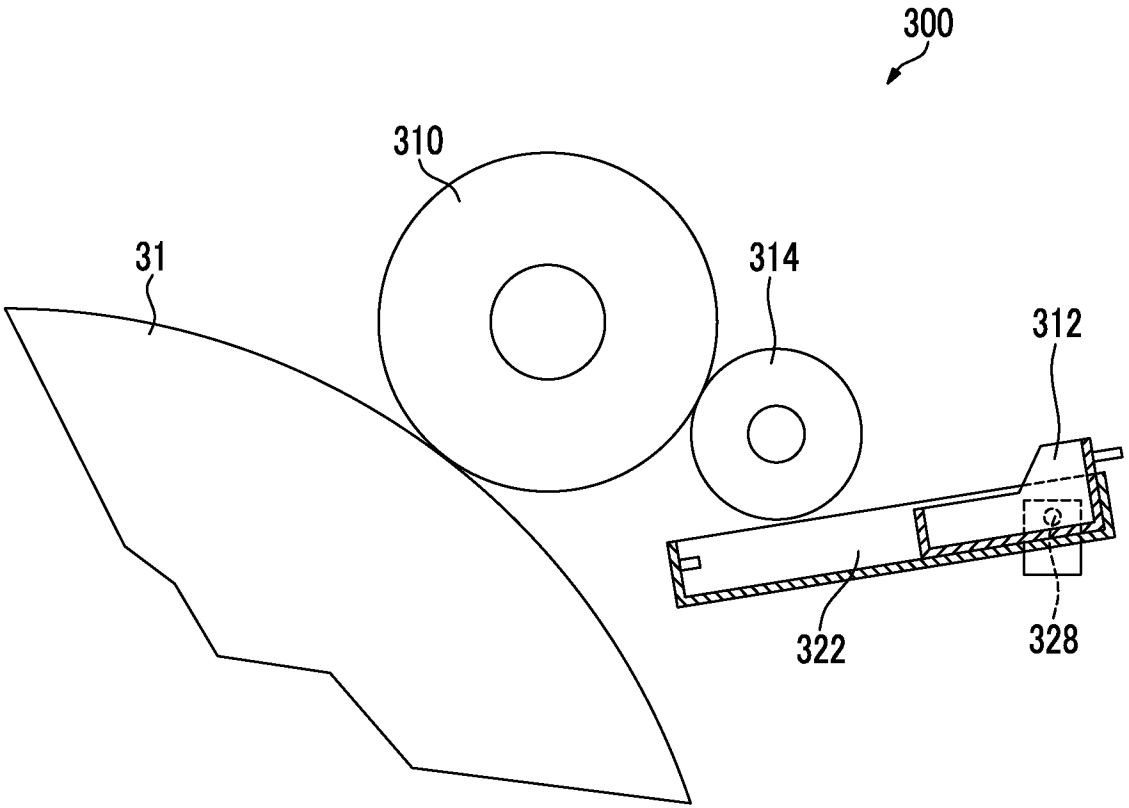
FIG. 8 is an explanatory view of a coating liquid pan attachment and detachment method.

In a case of attaching the coating liquid pan 312, first, as shown in FIG. 7, the receiving pan 322 is located at a predetermined retraction position. In this state, as shown in FIG. 8, the coating liquid pan 312 is accommodated in the receiving pan 322.

Figure 9:
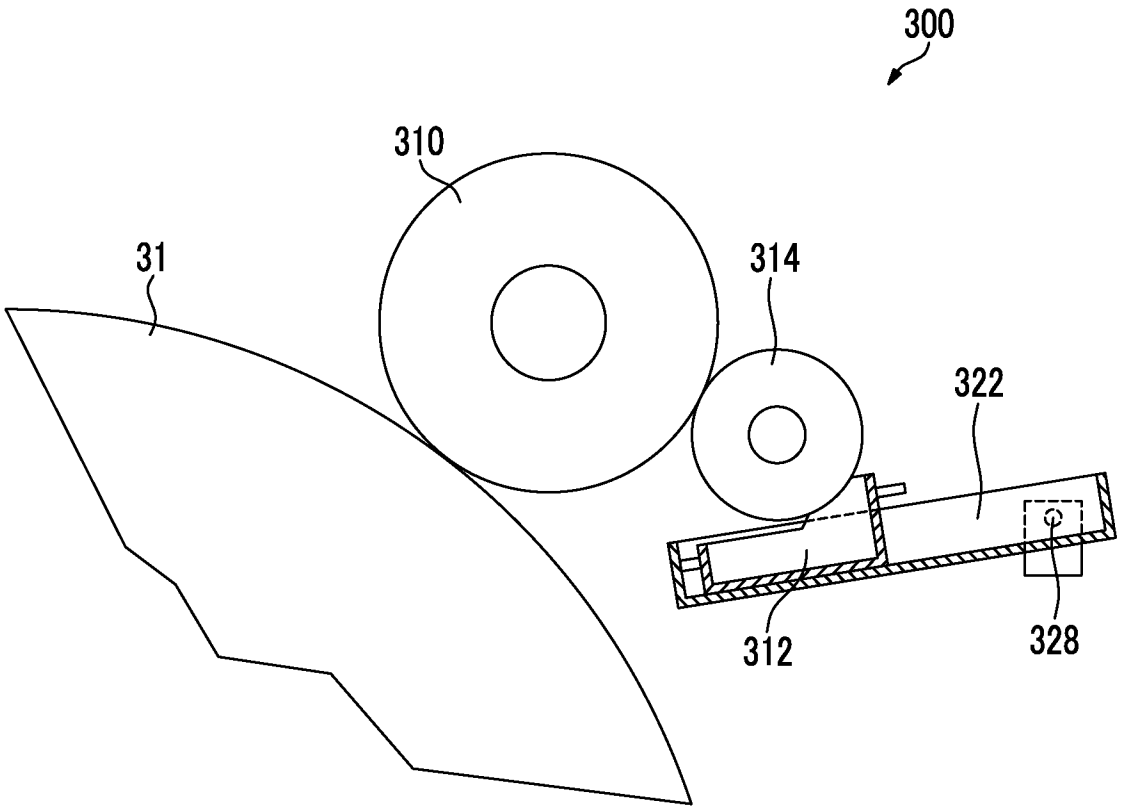
FIG. 9 is an explanatory view of a coating liquid pan attachment and detachment method.

Next, the coating liquid pan 312 is moved forward and is set at the attachment position. When the coating liquid pan 312 is moved forward inside the receiving pan, the guide rollers 324 come into contact with both lateral surfaces thereof, whereby positioning in the width direction is performed. The leading end surface comes into contact with the stopper 326, whereby positioning in the front-back direction is performed. Accordingly, the coating liquid pan 312 is correctly positioned at the attachment position and set. When the coating liquid pan 312 is set at the attachment position, as shown in FIG. 9, the coating liquid pan 312 is arranged at a position below (substantially directly below) the coating liquid supply roller 314.

Next, the respective pipes of the supply pipe 374, the waste liquid discharge pipe 384, and the circulation pipe 392 are connected to the coating liquid pan 312 (see FIG. 6).

Next, the receiving pan 322 is moved to a predetermined immersion position by the receiving pan elevating mechanism 340. This movement is done by rotating the knob 364.

Figure 10:
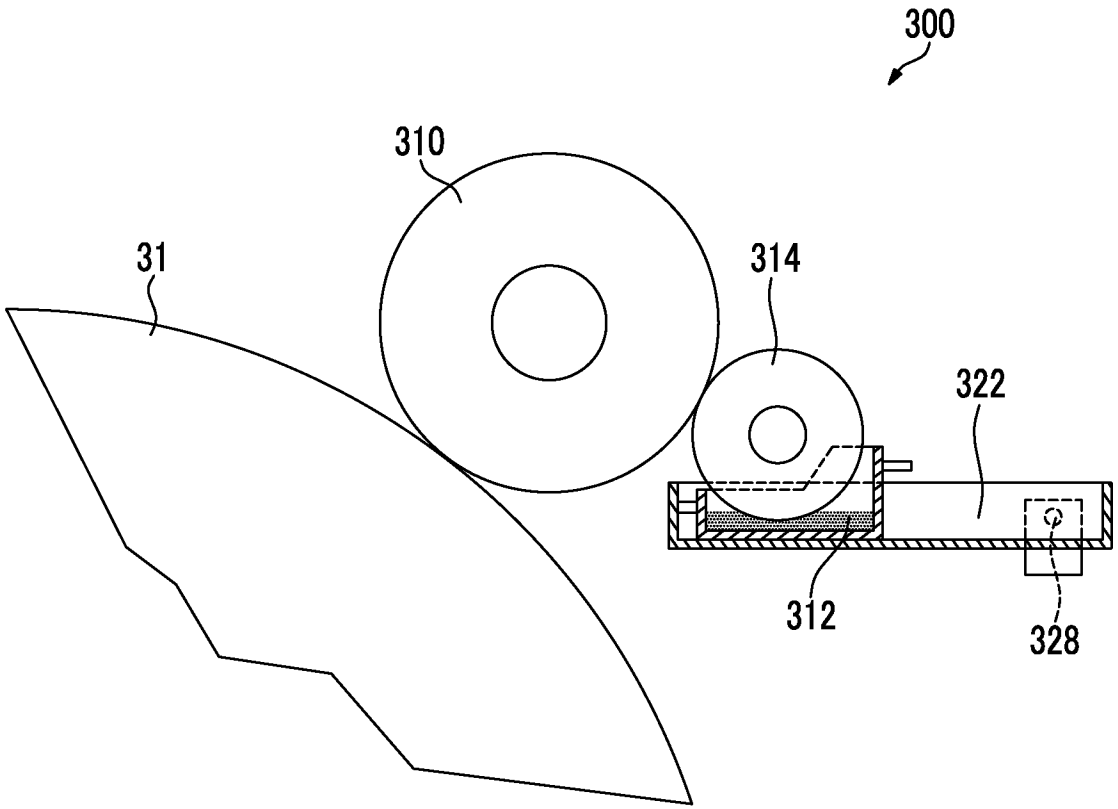
FIG. 10 is an explanatory view of a coating liquid pan attachment and detachment method.

When the receiving pan 322 is moved to the immersion position, as shown in FIG. 10, the coating liquid pan 312 is substantially held in a horizontal posture. The lower end portion of the coating liquid supply roller 314 is accommodated and arranged inside the coating liquid pan 312. Accordingly, it is possible to allow the lower end portion of the coating liquid supply roller 314 to be immersed in the processing liquid.

Next, the processing liquid is supplied to the coating liquid pan 312. The supply of the processing liquid is performed by driving the supply pump 376 in a state where the waste liquid discharge valve 388 is closed and the supply valve 378 is open. Accordingly, the processing liquid is supplied from the processing liquid tank 372 to the coating liquid pan 312.

A given amount of processing liquid is supplied. After a given amount of processing liquid is supplied, the driving of the supply pump 376 is stopped, and the supply valve 378 is closed. Accordingly, the processing liquid remains in the coating liquid pan 312, and as shown in FIG. 10, the lower end portion of the coating liquid supply roller 314 is immersed in the processing liquid.

With the above, the attachment of the coating liquid pan 312 is completed.

Next, a coating operation will be described.

First, the coating roller 310 is rotated. Accordingly, the coating liquid supply roller 314 rotates. The coating liquid supply roller 314 rotates, and thus the processing liquid stored in the coating liquid pan 312 is drawn up by the coating liquid supply roller 314. An excess amount of the drawn processing liquid is scraped off by the blade 316, and the processing liquid is adjusted to a given thickness. Thereafter, the coating liquid supply roller 314 comes into contact with the surface of the coating roller 310, and thus the processing liquid is transferred and supplied to the surface of the coating roller 310.

The coating roller 310 is pressed into contact with the processing liquid coating drum 31 in conformity with the passage timing of the sheet P. That is, if the leading end of the sheet P reaches the installation position of the coating roller 310, the coating roller 310 is pressed into contact with the processing liquid coating drum 31. If the leading end of the sheet P passes through the installation position of the coating roller 310, the coating roller 310 is away from the processing liquid coating drum 31. Accordingly, it is possible to coat the processing liquid only on the sheet P.

Here, during the coating operation, the processing liquid in the coating liquid pan is circulated and supplied by the circulation system 390 of the processing liquid supply system 320. That is, the circulation pump 394 is driven, and thus the processing liquid is circulated and supplied. Accordingly, it is possible to constantly maintain uniform quality of the processing liquid.

Next, a case of detaching the coating liquid pan 312 will be described.

First, the processing liquid stored in the coating liquid pan 312 is discharged. The discharge of the processing liquid is performed by driving the waste liquid discharge pump 386 in a state where the supply valve 378 is closed and the waste liquid discharge valve 388 is open. Accordingly, the processing liquid in the coating liquid pan 312 is recovered by the waste liquid discharge tank 382.

Next, the receiving pan 322 is move to a predetermined retraction position by the receiving pan elevating mechanism 340. This movement is done by rotating the knob 364.

When the receiving pan 322 moves to the retraction position, as shown in FIG. 9, the coating liquid pan 312 moves backward from the coating liquid supply roller 314. Accordingly, it becomes possible to move the coating liquid pan 312 along the receiving pan 322, and thus to perform detachment.

First, the respective pipes of the supply pipe 374, the waste liquid discharge pipe 384, and the circulation pipe 392 are detached from the coating liquid pan 312. Since the respective pipes are connected by a valved coupling, there is no case where the liquid overflows even at the time of detachment.

After the respective pipes are detached, the coating liquid pan 312 slides backward, and the coating liquid pan 312 is drawn from below the coating liquid supply roller 314. Accordingly, as shown in FIG. 8, the upper portion of the coating liquid pan 312 is opened, whereby the coating liquid pan 312 can be detached from the coating apparatus 300.

The detached coating liquid pan 312 is assembled in the coating apparatus 300 again in the above-described order after maintenance, such as cleaning.

In this way, according to the coating apparatus 300 of this embodiment, it is possible to detach the coating liquid pan 312 separately. Therefore, it is possible to easily perform maintenance, such as cleaning of the coating liquid pan 312.

Second Embodiment

Figure 11:
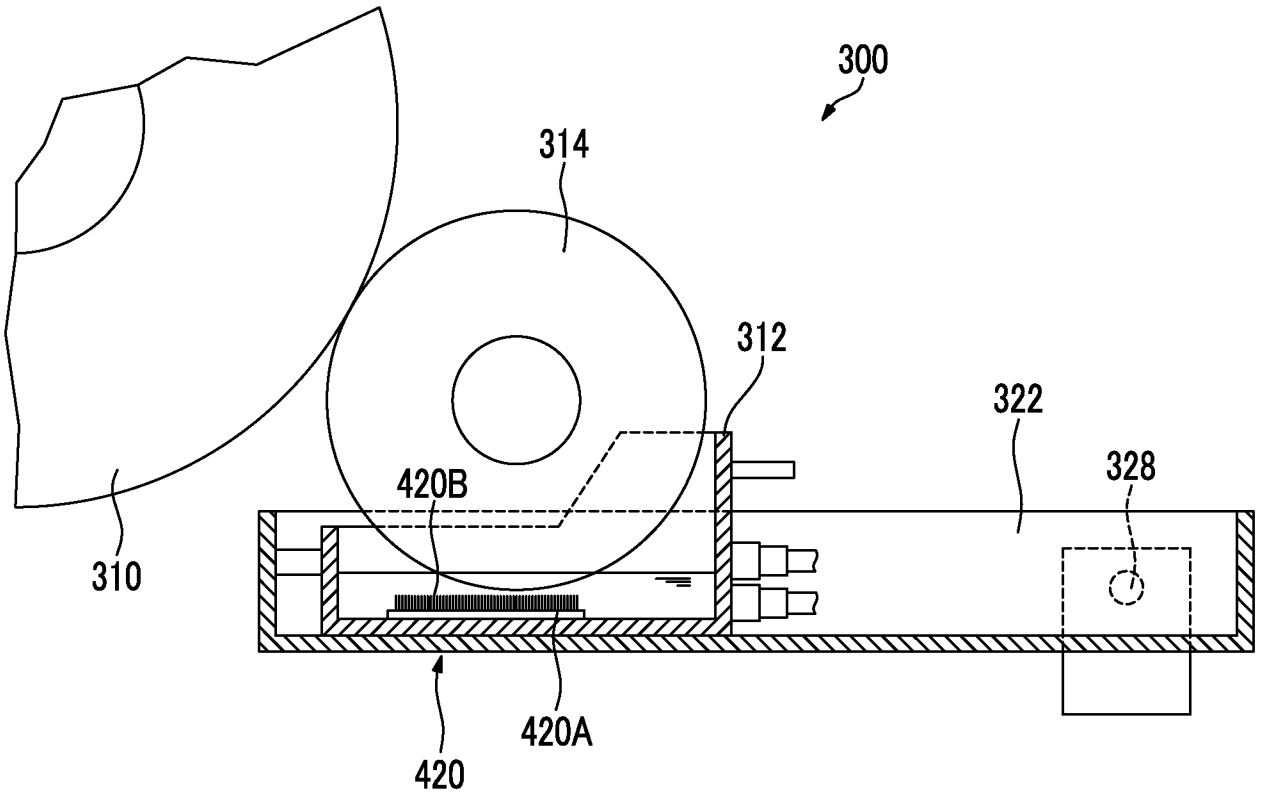
FIG. 11 is a sectional side view showing the configuration of a main part of a second embodiment of a coating apparatus.

FIG. 11 is a sectional side view showing the configuration of a main part of a second embodiment of a coating apparatus.

A coating apparatus 300 of this embodiment is different from the coating apparatus 300 of the above-described embodiment in that a cleaning brush 420 is provided inside the coating liquid pan 312.

The cleaning brush 420 functions as a cleaning unit of the coating liquid supply roller 314, and is pressed into contact with the circumferential surface of the coating liquid supply roller 314 to clean the coating liquid supply roller 314.

The configuration is the same as the coating apparatus 300 of the above-described embodiment except that the cleaning brush 420 is provided. Here, only the configuration and functional effect of the cleaning brush 420 will be described.

Figure 12:
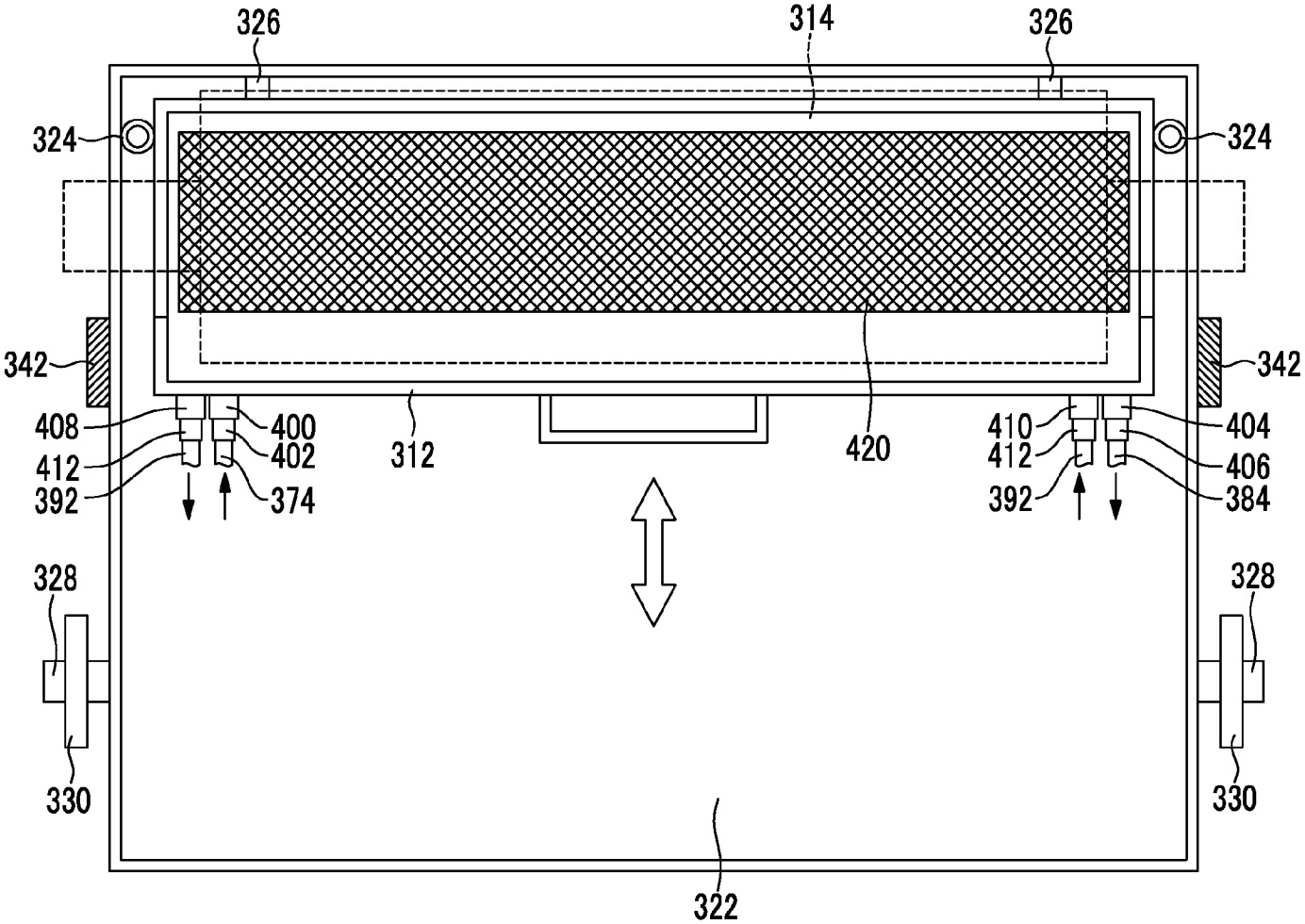
FIG. 12 is a plan view showing the configuration of a main part of the second embodiment of the coating apparatus.

The cleaning brush 420 is constituted by providing multiple brush bristles 420B in the surface of a rectangular sheet 420A. As shown in FIG. 12, the cleaning brush 420 is formed to substantially the same width as the width of the coating liquid supply roller 314, and is provided on the bottom surface of the coating liquid pan 312.

Cleaning of the coating liquid supply roller 314 using the cleaning brush 420 is performed in the following manner.

As described above, the coating liquid pan 312 moves up and down by moving the receiving pan 322 up and down.

When the receiving pan 322 is located at the immersion position, the lower end portion of the coating liquid supply roller 314 is immersed in the processing liquid stored in the coating liquid pan 312.

As shown in FIG. 11, when the receiving pan 322 is located at the immersion position, the cleaning brush 420 does not come into contact with the coating liquid supply roller 314, and is arranged below the coating liquid supply roller 314 at a predetermined distance.

Figure 13:
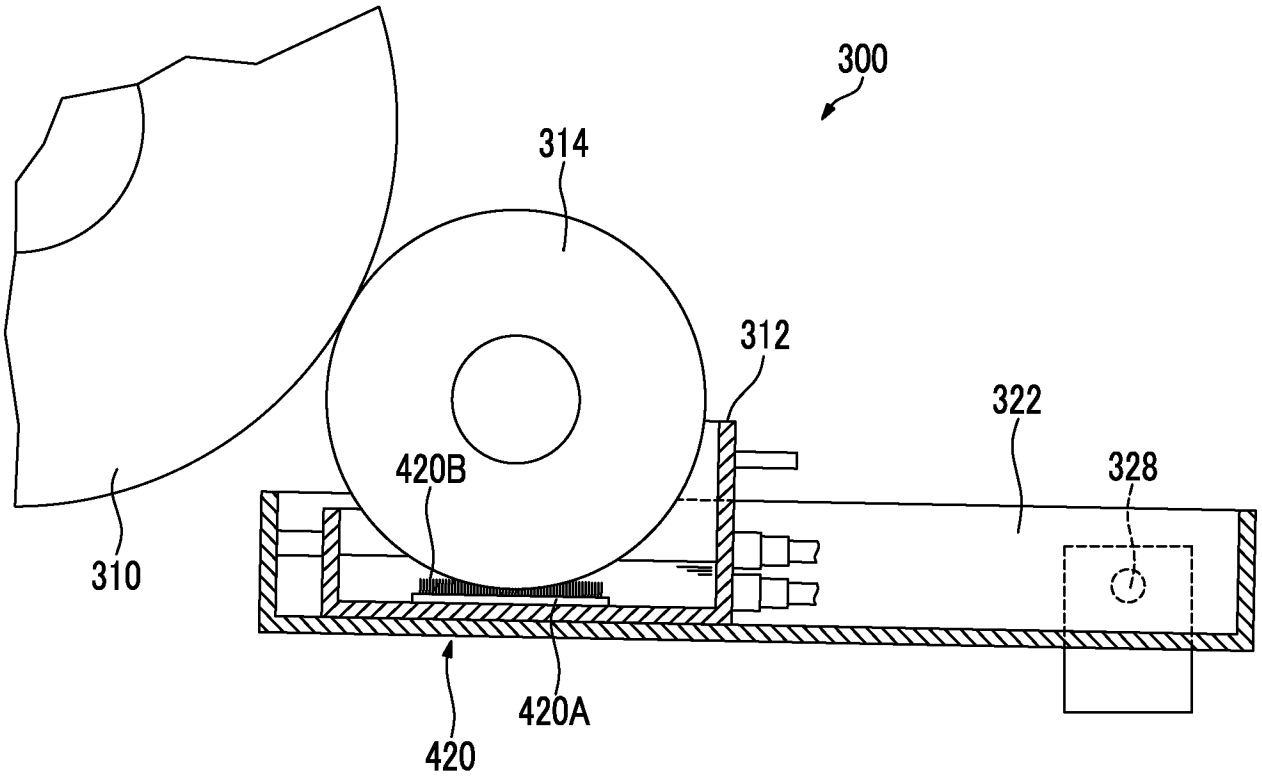
FIG. 13 is an explanatory view of an action of the coating apparatus of the second embodiment.

When cleaning the coating liquid supply roller 314, the receiving pan 322 is further moved up from the immersion position and located at a predetermined cleaning position. Accordingly, as shown in FIG. 13, the cleaning brush 420 comes into contact with the coating liquid supply roller 314. The coating liquid supply roller 314 rotates in a state where the cleaning brush 420 is in contact, and thus the surface of the coating liquid supply roller 314 sequentially comes into contact with the cleaning brush 420 and is cleaned.

When ending cleaning, the receiving pan 322 is moved down to the immersion position. Accordingly, as shown in FIG. 11, the coating liquid supply roller 314 and the cleaning brush 420 are away from each other.

Figure 14:
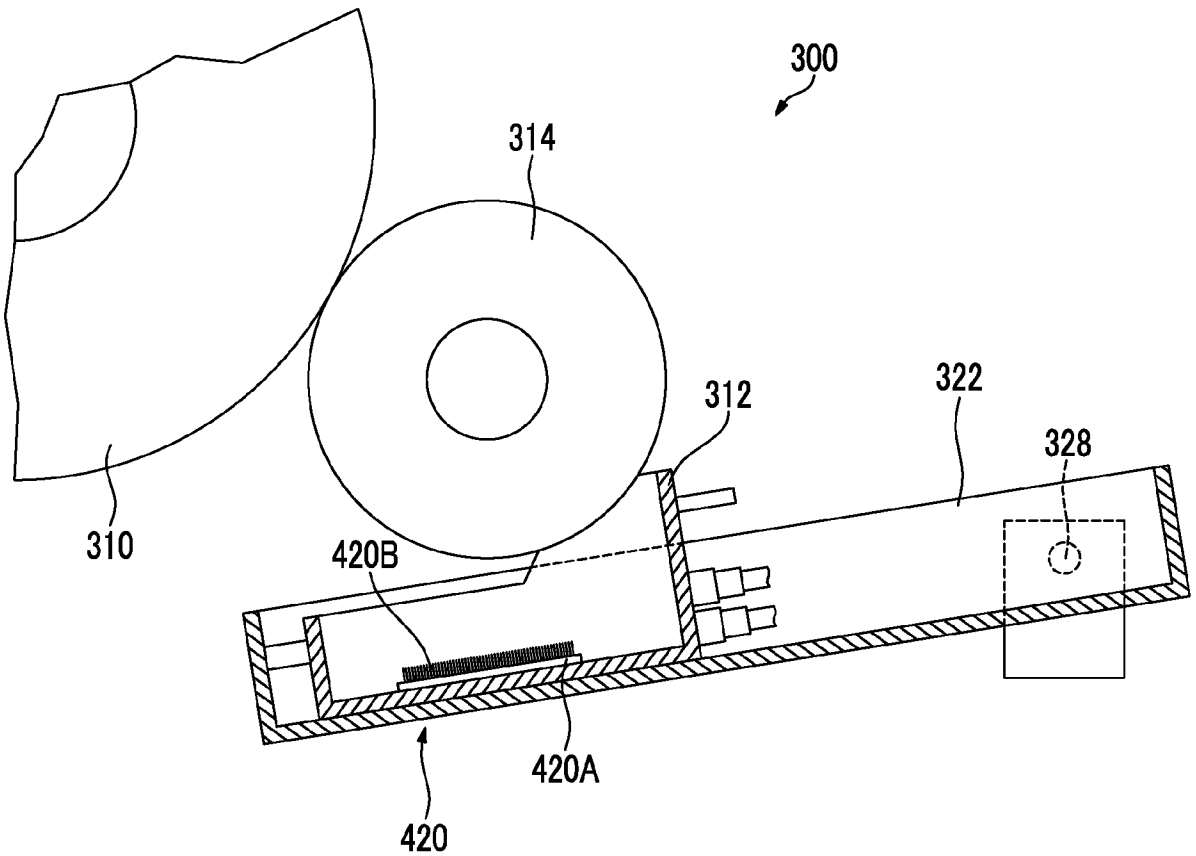
FIG. 14 is an explanatory view of an action of the coating apparatus of the second embodiment.

When the receiving pan 322 is moved to the retraction position, as shown in FIG. 14, the coating liquid pan 312 is away from the coating liquid supply roller 314. Accordingly, it becomes possible to detach the coating liquid pan 312.

In this way, according to the coating apparatus 300 of this embodiment, with the use of a mechanism which moves the coating liquid pan 312 up and down, it is possible to perform cleaning of the coating liquid supply roller 314. Accordingly, it is possible to save time and effort of detaching and cleaning the coating liquid supply roller 314 and thus to easily perform maintenance. The cleaning brush 420 being provided in the coating liquid pan 312, it is possible to clean the coating liquid supply roller 314 without large-scale equipment.

Although in this embodiment, a brush is used as a cleaning unit, the cleaning unit is not limited thereto. For example, a blade, sponge, or the like may be used as a cleaning unit.

Third Embodiment

Figure 15:
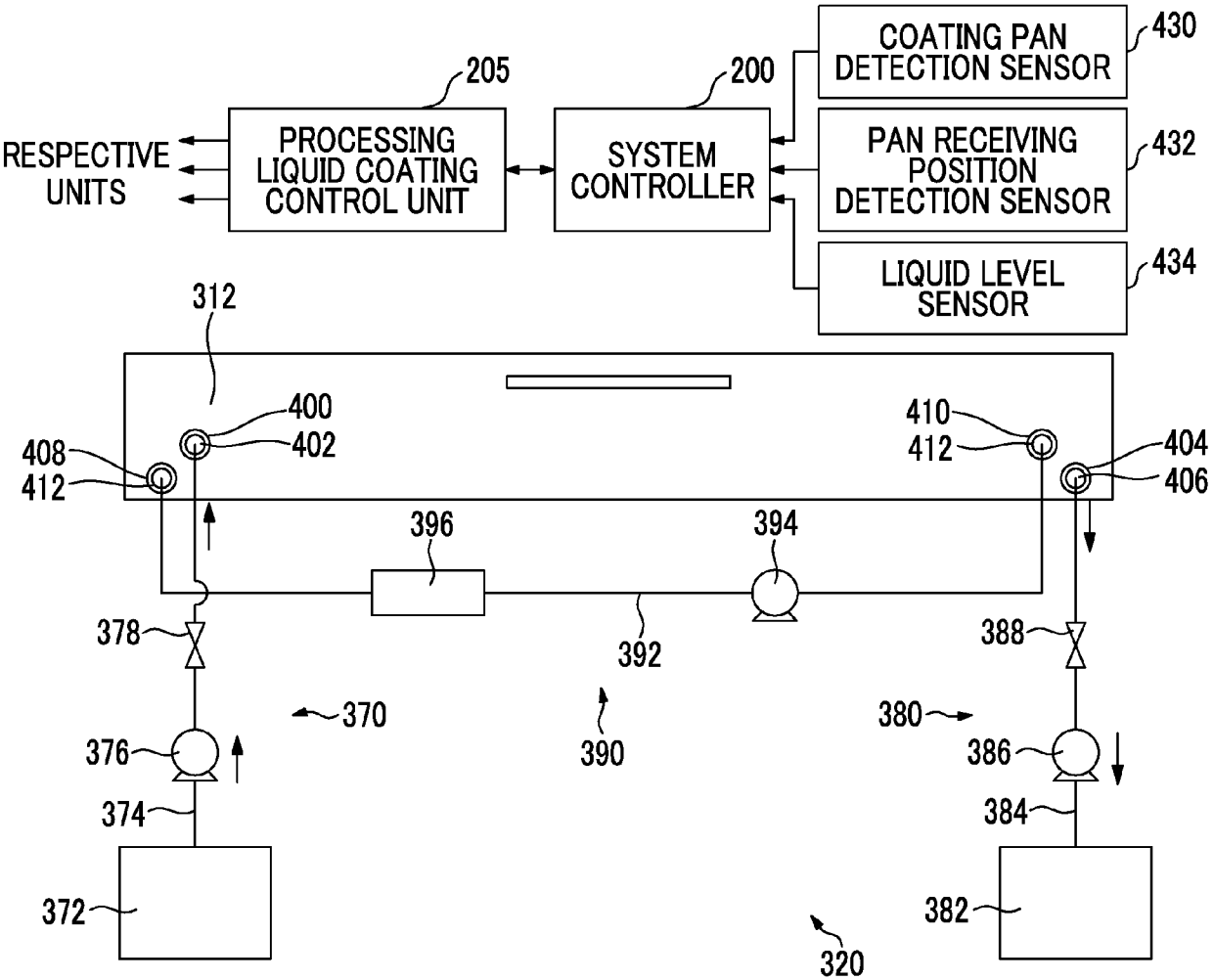
FIG. 15 is a system configuration diagram of a main part of a third embodiment of a coating apparatus.

FIG. 15 is a system configuration diagram of a main part of a third embodiment of a coating apparatus.

A coating apparatus 300 of this embodiment is configured so as to automatically perform the supply and discharge of the processing liquid depending on the presence/absence of the coating liquid pan 312.

The basic configuration of the coating apparatus is the same as the coating apparatus 300 of the above-described embodiment, and thus only a configuration for automatically performing the supply and discharge of the processing liquid will be described.

As described above, the supply and discharge of the processing liquid are performed in a state where the coating liquid pan 312 is set at the attachment position, and the receiving pan 322 is located at the immersion position. To this end, the coating apparatus 300 of this embodiment includes a coating liquid pan detection sensor (detection unit) 430 which detects the presence/absence of the attachment of the coating liquid pan 312 at the attachment position, and receiving pan position detection sensor (detection unit) 432 which detects the position of the receiving pan 322.

For example, the coating liquid pan detection sensor 430 detects the coating liquid pan 312 coming into contact with the stopper 326, and detects the coating liquid pan 312 being attached at the attachment position. The detection result of the coating liquid pan detection sensor 430 is output to the system controller 200.

For example, the receiving pan position detection sensor 432 includes a sensor which detects the receiving pan 322 being located at the immersion position, and a sensor which detects the receiving pan 322 being located at the retraction position. The sensor which detects the receiving pan 322 being located at the immersion position is constituted by, for example, a sensor which comes into contact with the receiving pan 322 and is turned on when the receiving pan 322 is located at the immersion position. Similarly, the sensor which detects the receiving pan 322 being located at the retraction position is constituted by a sensor which comes into contact with the receiving pan 322 and is turned on when the receiving pan 322 is located at the retraction position. The detection result of the receiving pan position detection sensor 432 is output to the system controller 200.

The coating apparatus 300 of the embodiment further includes a liquid level sensor 434 which detects the liquid level of the processing liquid stored in the coating liquid pan 312. The detection result of the liquid level sensor 434 is output to the system controller 200.

The system controller 200 functions as a supply and waste liquid discharge control unit, and controls the respective units (the supply pump 376, the supply valve 378, the waste liquid discharge pump 386, the waste liquid discharge valve 388, the circulation pump 394, and the like) of the processing liquid supply system 320 on the basis of the detection results of the respective sensors through the processing liquid coating control unit 205. Hereinafter, this control method will be described.

As described above, the supply and discharge of the processing liquid are performed in a state where the coating liquid pan 312 is set at the attachment position, and the receiving pan 322 is located at the immersion position.

The system controller 200 determines whether or not the coating liquid pan 312 is attached to the attachment position on the basis of the output from the coating liquid pan detection sensor 430. The system controller 200 also determines whether or not the receiving pan 322 is located at the immersion position on the basis of the output from the receiving pan position detection sensor 432.

If it is determined that the coating liquid pan 312 is located at the attachment position, and the receiving pan 322 is located at the immersion position, the system controller 200 controls the respective units of the processing liquid supply system 320 through the processing liquid coating control unit 205, and starts to supply the processing liquid to the coating liquid pan 312. That is, the waste liquid discharge valve 388 is closed, the supply valve 378 is opened, and the supply pump 376 is driven. Accordingly, the processing liquid is supplied from the processing liquid tank 372 to the coating liquid pan 312.

The system controller 200 monitors the liquid level of the processing liquid to be stored in the coating liquid pan 312 by the output from the liquid level sensor 434. If the liquid level of the processing liquid reaches a reference height set in advance, the driving of the supply pump 376 is stopped, and the supply valve 378 is closed. Accordingly, a predetermined amount of processing liquid is stored in the coating liquid pan 312, and the lower end portion of the coating liquid supply roller 314 is immersed in the processing liquid.

During the coating operation, the system controller 200 drives the circulation pump 394 to circulate the processing liquid stored in the coating liquid pan 312.

During the coating operation, the system controller 200 monitors the liquid level of the processing liquid to be stored in the coating liquid pan 312, and appropriately replenishes the processing liquid. That is, when the liquid level of the processing liquid is lowered to be equal to or smaller than a given level, the supply valve 378 is opened and the supply pump 376 is driven to replenish the processing liquid. Accordingly, it is possible to constantly maintain the processing liquid in a given range.

The circulation and replenishment of the processing liquid are performed by confirming the presence/absence of the coating liquid pan 312 and the position of the receiving pan 322. Similarly, the discharge of the processing liquid is also performed by confirming the presence/absence of the coating liquid pan 312 and the position of the receiving pan 322.

In this way, according to the coating apparatus 300 of this embodiment, the attachment of the coating liquid pan 312 is confirmed, and the supply and discharge of the processing liquid are automatically performed. Accordingly, it is possible to prevent the processing liquid from being erroneously supplied and contaminating the surrounding.

Although in this embodiment, the supply, discharge, circulation, and the like of the processing liquid are performed by monitoring the presence/absence of the attachment of the coating liquid pan 312 at the attachment position and the position of the receiving pan 322, the presence/absence of connection of the respective pipes to the supply port 400, the waste liquid discharge port 404, the circulation supply port 408, and the circulation recovery port 410 may be detected by sensors, and only when the respective pipes are connected, the supply, discharge, circulation, and the like of the processing liquid may be performed. Therefore, it is possible to perform the supply and the like of the processing liquid more safely.

The supply, discharge, circulation, and the like of the processing liquid may be performed by monitoring only the position of the receiving pan 322.

Other Embodiments

Although in the foregoing embodiments, a configuration in which the receiving pan 322 is moved up and down manually is made, a configuration in which the receiving pan 322 is moved up and down using driving means, such as a motor or a cylinder may be made. In particular, as in the second embodiment, when the cleaning unit is provided inside the coating liquid pan so as to clean the coating liquid supply roller 314, a configuration in which the receiving pan 322 is moved up and down by driving means to automatically clean the coating liquid supply roller 314 may be made.

Although in the foregoing embodiments, the receiving pan 322 has a function as the support unit of the coating liquid pan 312, the receiving pan 322 and the support unit of the coating liquid pan 312 may be separately provided. For example, a configuration in which the coating liquid pan 312 is slidably supported by a separate rail or the like, and the receiving pan 322 is provided below the coating liquid pan 312 may be made. As in the foregoing embodiments, a configuration in which the coating liquid pan 312 is supported by the receiving pan 322 is made, thereby achieving simplification of the configuration.

Although in the foregoing embodiments, a configuration in which the processing liquid to be stored in the coating liquid pan 312 is circulated and supplied by the circulation system 390 is made, a configuration in which the circulation system 390 is removed may be made. If the circulation system 390 is provided, as described above, it is possible to prevent the processing liquid from being concentrated and to stabilize quality of the processing liquid.

When the circulation system 390 is provided, a buffer tank may be further provided in the circulation pipe 392. Accordingly, it is possible to increase the sequential completion of the processing liquid and to further stabilize quality of the processing liquid.

When the circulation system 390 is provided, it is preferable that a pump, such as a tube pump, which switches the liquid feed direction is used as the circulation pump 394. If the processing liquid is constantly circulated in one direction (a flow from the circulation supply port 408 toward the circulation recovery port 410 inside the coating liquid pan), a foreign substance or the like remains in the flow channel on the recovery side of the circulation recovery port 410 or the circulation pipe 392, and inhibits the flow of the processing liquid. However, if the direction in which the processing liquid flows is appropriately switched, it is possible to sweep a foreign substance or the like remaining in the flow channel on the recovery side of the circulation recovery port 410 or the circulation pipe 392 inside the coating liquid pan. Accordingly, it is possible to prevent clogging of the circulation recovery port 410 or the circulation pipe 392. For example, the switching of the circulation direction is carried out every given time. For example, the switching is carried at the time of the discharge of the processing liquid (before the discharge of the processing liquid).

Although in this embodiment, a configuration in which the processing liquid drawn up by the coating liquid supply roller 314 is directly supplied to the coating roller 310 is made, a configuration in which an intermediate roller is provided between the coating liquid supply roller 314 and the coating roller 310, and the processing liquid is supplied from the coating liquid supply roller 314 to the coating roller 310 through the intermediate roller may be made.

Although in this embodiment, a configuration in which the processing liquid drawn up by the coating liquid supply roller 314 is supplied to the coating roller 310, and the processing liquid is coated on the sheet P by the coating roller 310 is made, a configuration in which the processing liquid drawn up by the coating liquid supply roller 314 is coated directly on the sheet P by the coating liquid supply roller 314 may be made. That is, instead of coating the processing liquid drawn up by the coating liquid supply roller 314 indirectly on the sheet P through the coating roller 310, a configuration in which the processing liquid drawn up by the coating liquid supply roller 314 is coated directly on the sheet P by the coating liquid supply roller 314 may be made.

Although in this embodiment, a transport drum is used as a transport unit of a sheet as an object to be coated, the transport unit of the sheet is not limited thereto. For example, a configuration in which a sheet is absorbed and held by a rotating belt and transported (so-called belt transport) may be made. Alternatively, a configuration in which a sheet is absorbed and held by a traveling table and transported (so-called table transport) may be made.

Although in this embodiment, as a mechanism which moves the receiving pan up and down (a mechanism which moves the receiving pan relatively with respect to the processing liquid supply roller), a configuration in which the receiving pan is swingably supported, and the receiving pan is swung by an elevating mechanism arranged above the receiving pan to move the receiving pan up and down is made, a mechanism which moves the receiving pan as a support unit up and down is not limited thereto. A configuration in which the receiving pan is moved up down by an elevating mechanism (for example, a cylinder or the like) arranged below the receiving pan may be made.

As in this embodiment, the relative movement unit of the receiving pan being arranged above the receiving pan and the coating liquid supply roller, even when there is no enough space below the receiving pan, it is possible to move the receiving pan up and down and thus to enable the attachment and detachment of the receiving pan.

Although in this embodiment, as the positioning unit which positions the coating liquid pan, the stopper and the guide rollers are used, means for positioning the coating liquid pan at the attachment position is not limited thereto. For example, a method in which a stopper may be arranged on the leading end surface of the coating liquid pan and may be brought into contact with the leading end inner wall surface of the receiving pan to perform positioning in the front-back direction, a method in which the leading end surface of the coating liquid pan is brought into contact with the leading end inner wall surface of the receiving pan to perform positioning in the front-back direction, or the like may be introduced. A rail may be provided inside the receiving pan, and the receiving pan may be traveled along the rail so as to regulate the movement in the width direction (positioning in the width direction).

What is claimed is:

1. A coating apparatus comprising:

a transport unit configured to transport an object to be coated, the object having a sheet-like shape;

a coating liquid pan configured to store a coating liquid;

a roller configured to be partially immersed in the coating liquid stored in the coating liquid pan, rotate around an axis to draw up the coating liquid, and coat the drawn coating liquid directly or indirectly on the object transported by the transport unit;

a support unit configured to detachably support the coating liquid pan and slidably supports the coating liquid pan attached to the support unit in a direction perpendicular to the rotation axis of the roller;

a positioning unit configured to position the coating liquid pan attached to the support unit at an attachment position;

a relative movement unit configured to relatively moves the support unit and the roller; and a receiving pan arranged below the coating liquid pan, the receiving pan being configured to recover the coating liquid overflowing from the coating liquid pan;

wherein, when the support unit is located at an immersion position relatively with respect to the roller by the relative movement unit in a state where the coating liquid pan is located at the attachment position, a part of the roller is immersed in the coating liquid stored in the coating liquid pan, wherein, when the support unit is located at a retraction position relatively with respect to the roller by the relative movement unit, the coating liquid pan is slidably supported without being brought into contact with the roller, and wherein the support unit is provided in the receiving pan, and the relative movement unit moves the receiving pan relatively with respect to the roller and thereby moves the support unit relatively with respect to the roller.

2. The coating apparatus according to claim 1, wherein the transport unit is a transport drum configured to rotate with the object being wound around a circumferential surface thereof and thereby transport the object.

3. The coating apparatus according to claim 1, wherein the receiving pan is supported swingably around a swing shaft parallel to the rotation axis of the roller, and the relative movement unit swings the receiving pan around the swing shaft and thereby moves the support unit relatively with respect to the roller.

4. The coating apparatus according to claim 3, wherein the relative movement unit comprises an arm of which lower end portion is connected to the receiving pan and which extends upward, the relative movement unit moving the arm up and down and thereby having the receiving pan swing.

5. The coating apparatus according to claim 4, wherein the roller is attached to a support portion which is configured to support the roller, the roller being attached thereto in such a manner that the roller is detached from a given direction with respect to the support portion, and the arm is provided in such a manner that the arm avoid a movement path of the roller at a time of attachment and detachment of the roller.

6. The coating apparatus according to claim 1, further comprising:

a circulation supply port which is provided in the coating liquid pan;

a circulation recovery port which is provided in the coating liquid pan;

a circulation pipe which communicates the circulation supply port and the circulation recovery port; and a circulation pump which is provided in the circulation pipe, the circulation pump being configured to circulate the coating liquid stored in the coating liquid pan through the circulation pipe.

7. The coating apparatus according to claim 6, wherein the circulation pipe is connected to the circulation supply port and the circulation recovery port through a valved coupling.

8. The coating apparatus according to claim 6, wherein the circulation supply port is provided in a first end portion in a width direction of the coating liquid pan, and the circulation recovery port is provided in a second end portion in the width direction of the coating liquid pan.

9. The coating apparatus according to claim 6, further comprising:

a filter which is provided in the circulation pipe, the filter being configured to filter the coating liquid flowing through the circulation pipe.

10. The coating apparatus according to claim 6, wherein the circulation pump is configured to switch a liquid feed direction.

11. The coating apparatus according to claim 1, further comprising:

a cleaning unit which is provided inside the coating liquid pan, the cleaning unit being configured to being brought into contact with the circumferential surface of the roller and thereby clean the circumferential surface of the roller, wherein, when the support unit is located at a cleaning position, the cleaning unit is brought into contact with the circumferential surface of the roller.

12. The coating apparatus according to claim 1, wherein the coating liquid pan is slidably supported along the bottom surface of the receiving pan.

13. A coating apparatus comprising:

a transport unit configured to transport an object to be coated, the object having a sheet-like shape;

a coating liquid pan configured to store a coating liquid;

a roller configured to be partially immersed in the coating liquid stored in the coating liquid pan, rotate around an axis to draw up the coating liquid, and coat the drawn coating liquid directly or indirectly on the object transported by the transport unit;

a support unit configured to detachably support the coating liquid pan and slidably supports the coating liquid pan attached to the support unit in a direction perpendicular to the rotation axis of the roller;

a positioning unit configured to position the coating liquid pan attached to the support unit at an attachment position;

a relative movement unit configured to relatively moves the support unit and the roller;

a supply port which is provided in the coating liquid pan;

a coating liquid supply unit configured to supply the coating liquid to the coating liquid pan through the supply port;

a waste liquid discharge port which is provided in the coating liquid pan;

a waste coating liquid discharge unit configured to discharge the coating liquid from the coating liquid pan through the waste liquid discharge port;

a detection unit configured to detect a position of the support unit; and a supply and waste liquid discharge control unit configured to control the coating liquid supply unit and the waste coating liquid discharge unit based upon a result of detection by the detection unit;

wherein, when the support unit is located at an immersion position relatively with respect to the roller by the relative movement unit in a state where the coating liquid pan is located at the attachment position, a part of the roller is immersed in the coating liquid stored in the coating liquid pan, and wherein, when the support unit is located at a retraction position relatively with respect to the roller by the relative movement unit, the coating liquid pan is slidably supported without being brought into contact with the roller.

14. The coating apparatus according to claim 13, further comprising:

a receiving pan arranged below the coating liquid pan, the receiving pan being configured to recover the coating liquid overflowing from the coating liquid pan.

15. The coating apparatus according to claim 14, wherein the support unit is provided in the receiving pan, and the relative movement unit moves the receiving pan relatively with respect to the roller and thereby moves the support unit relatively with respect to the roller.

16. The coating apparatus according to claim 15, wherein the receiving pan is supported swingably around a swing shaft parallel to the rotation axis of the roller, and the relative movement unit swings the receiving pan around the swing shaft and thereby moves the support unit relatively with respect to the roller.

17. The coating apparatus according to claim 16, wherein the relatively movement unit comprises an arm of which lower end portion is connected to the receiving pan and which extend upward, the relative movement unit moving the arm up and down and thereby having the receiving pan swing.

18. The coating apparatus according to claim 13, wherein the coating liquid supply unit is connected to the supply port through a valved coupling, and the waste coating liquid discharge unit is connected to the waste liquid discharge port through a valved coupling.

19. The coating apparatus according to claim 13, wherein the coating liquid pan is slidably supported along the bottom surface of the receiving pan.

20. An inkjet recording apparatus comprising:

the coating apparatus according to claim 1; and an inkjet head configured to eject ink onto the object to be coated which is coated with the coating liquid by the coating apparatus and thereby record an image.

* * * * *